US011289838B2

(12) United States Patent
Ashibu

(10) Patent No.: US 11,289,838 B2
(45) Date of Patent: Mar. 29, 2022

(54) CONNECTOR ASSEMBLY

(71) Applicant: Japan Aviation Electronics Industry, Ltd., Tokyo (JP)

(72) Inventor: Kenta Ashibu, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 9 days.

(21) Appl. No.: 17/063,148

(22) Filed: Oct. 5, 2020

(65) Prior Publication Data

US 2021/0167532 A1 Jun. 3, 2021

(30) Foreign Application Priority Data

Dec. 3, 2019 (JP) ..... JP2019-218599

(51) Int. Cl.

| | |
|---|---|
| ***H01R 12/71*** | (2011.01) |
| ***H01R 13/11*** | (2006.01) |
| ***H01R 13/631*** | (2006.01) |
| *H01R 12/70* | (2011.01) |
| *H01R 13/627* | (2006.01) |

(52) U.S. Cl.

CPC ..... *H01R 12/716* (2013.01); *H01R 13/11* (2013.01); *H01R 13/631* (2013.01); *H01R 12/707* (2013.01); *H01R 13/6273* (2013.01)

(58) Field of Classification Search

CPC .... H01R 12/716; H01R 12/707; H01R 12/57; H01R 12/73; H01R 13/11; H01R 13/631; H01R 13/6273; H01R 13/2442; H01R 13/112; H01R 24/005

See application file for complete search history.

(56) References Cited

U.S. PATENT DOCUMENTS

| | | | | |
|---|---|---|---|---|
| 8,998,624 | B2 * | 4/2015 | Ida | H01R 13/40 439/74 |
| 9,240,642 | B2 * | 1/2016 | Sagayama | H01R 12/78 |
| 9,287,645 | B2 * | 3/2016 | Hashiguchi | H01R 12/62 |
| 2015/0180148 | A1 * | 6/2015 | Hashiguchi | H01R 12/716 439/74 |

(Continued)

FOREIGN PATENT DOCUMENTS

| | | |
|---|---|---|
| JP | 2019-129137 A | 8/2019 |
| KR | 20120075934 A | 7/2012 |

OTHER PUBLICATIONS

Office Action in counterpart Chinese Patent Application No. 202011122730.0 dated Oct. 9, 2021, with English translation.

*Primary Examiner* — Abdullah A Riyami
*Assistant Examiner* — Nader J Alhawamdeh
(74) *Attorney, Agent, or Firm* — Renner, Otto, Boisselle & Sklar, LLP

(57) ABSTRACT

Each of plug contacts and each of receptacle contacts come into electrical contact with each other by mating a plug connector and a receptacle connector. Each of the receptacle contacts includes a receptacle contact guide part that has a receptacle contact guide hole into which each plug contact can be inserted in a direction toward a receptacle side board, and two spring pieces that are elastically deformed when each plug contact is inserted into the receptacle contact guide hole. The two spring pieces come into contact with each plug contact inserted into the receptacle contact guide hole by a spring restoring force.

7 Claims, 23 Drawing Sheets

(56) References Cited

U.S. PATENT DOCUMENTS

| | | | | |
|---|---|---|---|---|
| 2015/0280338 | A1* | 10/2015 | Komoto | H01R 12/716<br>439/670 |
| 2019/0229447 | A1* | 7/2019 | Tsukashima | H01R 13/115 |
| 2021/0167532 | A1* | 6/2021 | Ashibu | H01R 12/73 |

* cited by examiner

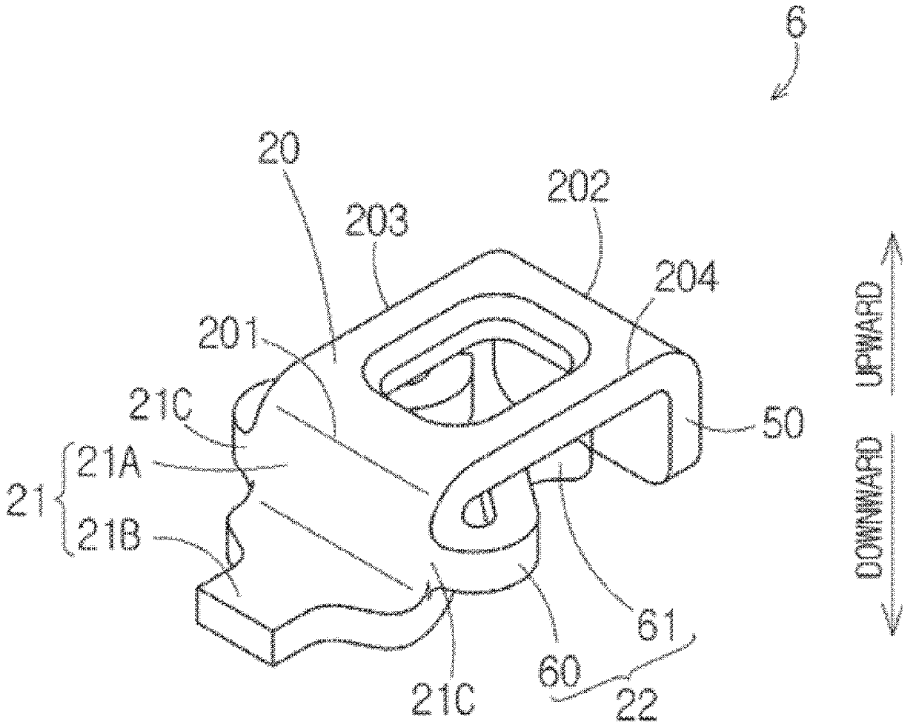
Fig. 21
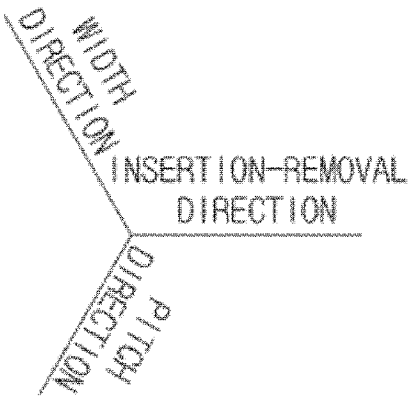

CONNECTOR ASSEMBLY

INCORPORATION BY REFERENCE

This application is based upon and claims the benefit of priority from Japanese patent application No. 2019-218599, filed on Dec. 3, 2019, the disclosure of which is incorporated herein in its entirety by reference.

BACKGROUND

The present disclosure relates to a connector assembly.

Patent Literature 1 (Japanese Unexamined Patent Application Publication No. 2019-129137) discloses a board-to-board connector assembly. As shown in FIG. 23 of the present application, the connector assembly disclosed in Patent Literature 1 includes a signal pin 100 mounted on a plug connector and a terminal 101 mounted on a receptacle connector. The connector assembly disclosed in Patent Literature 1 slides the plug connector into the receptacle connector so that the plug connector and the receptacle connector mate with each other.

Specifically, after inserting a signal contact part 102 of the signal pin 100 into a wide part 103 of the terminal 101, the plug connector is slid into the receptacle connector in the direction parallel to a mounting surface of a board.

SUMMARY

The structure of Patent Literature 1 described above is not tough enough because it does not have a guide part. Further, the mating of connectors is complicated because it is necessary to slide the plug connector after inserting the signal contact part 102 into the wide part 103.

An object of the present disclosure is to provide a technique to increase the toughness and simplify the mating operation in a board-to-board connector assembly.

According to an aspect of the present disclosure, there is provided a connector assembly including a plug connector including a plurality of plug contacts, and a plug housing that accommodates the plurality of plug contacts, the plug connector being mountable on a plug side board, and a receptacle connector including a plurality of receptacle contacts, and a receptacle housing that accommodates the plurality of receptacle contacts, the receptacle connector being mountable on a receptacle side board, wherein each of the plug contacts and each of the receptacle contacts come into electrical contact with each other by mating the plug connector and the receptacle connector, each of the receptacle contacts includes a guide part having a guide hole into which each of the plug contacts can be inserted in a direction toward the receptacle side board, and at least one spring piece elastically deformable when each of the plug contacts is inserted into the guide hole, and the at least one spring piece comes into contact with each of the plug contacts inserted into the guide hole by a spring restoring force.

According to the present disclosure, a simple mating operation is achieved.

The above and other objects, features and advantages of the present disclosure will become more fully understood from the detailed description given hereinbelow and the accompanying drawings which are given by way of illustration only, and thus are not to be considered as limiting the present disclosure.

BRIEF DESCRIPTION OF DRAWINGS

FIG. 21 is a perspective view of a receptacle contact (fourth embodiment);

DESCRIPTION OF EMBODIMENTS

First Embodiment

A first embodiment of the present disclosure is described hereinafter with reference to FIGS. 1 to 16.

Figure 1:
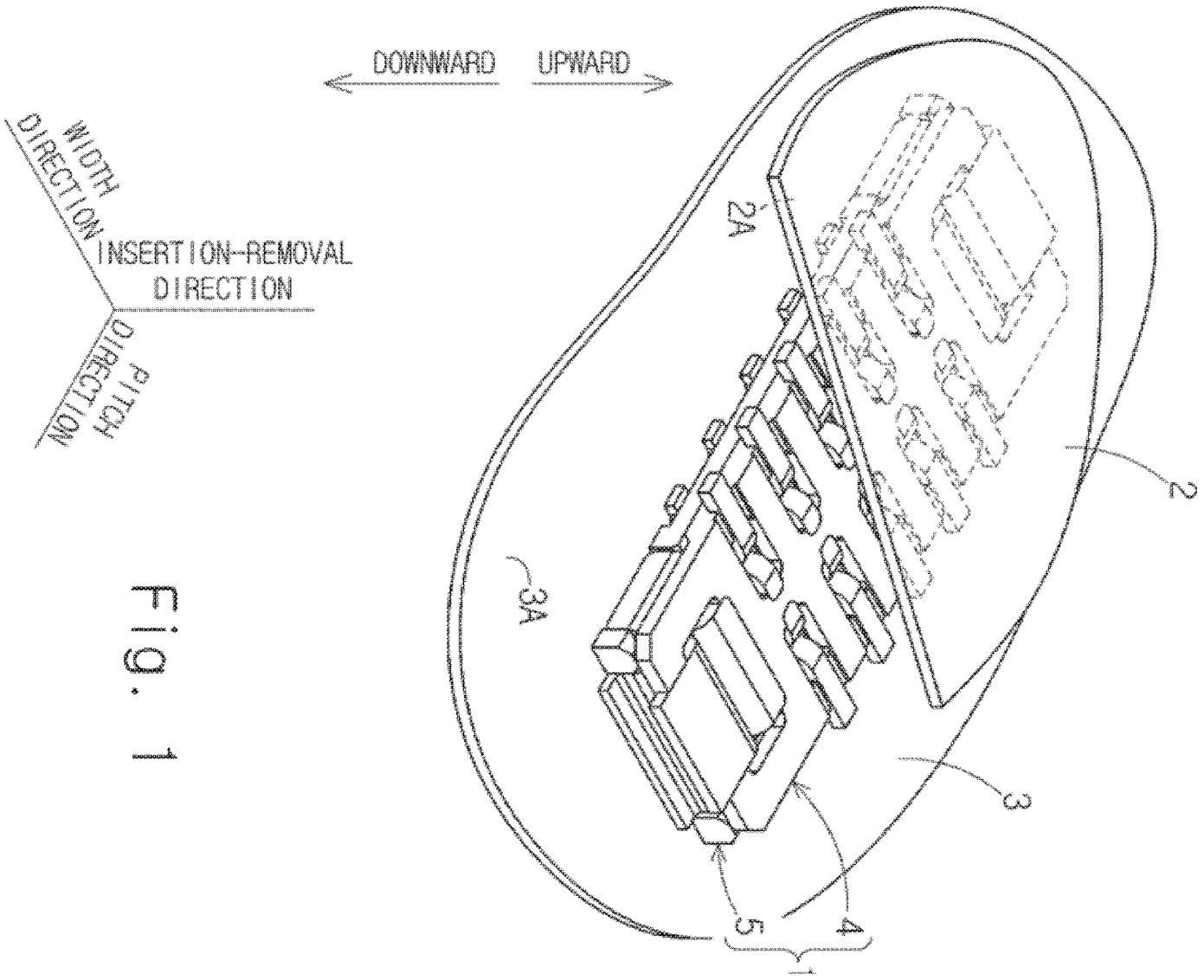
FIG. 1 is a perspective view of a connector assembly in a mated state (first embodiment)
Figure 2:
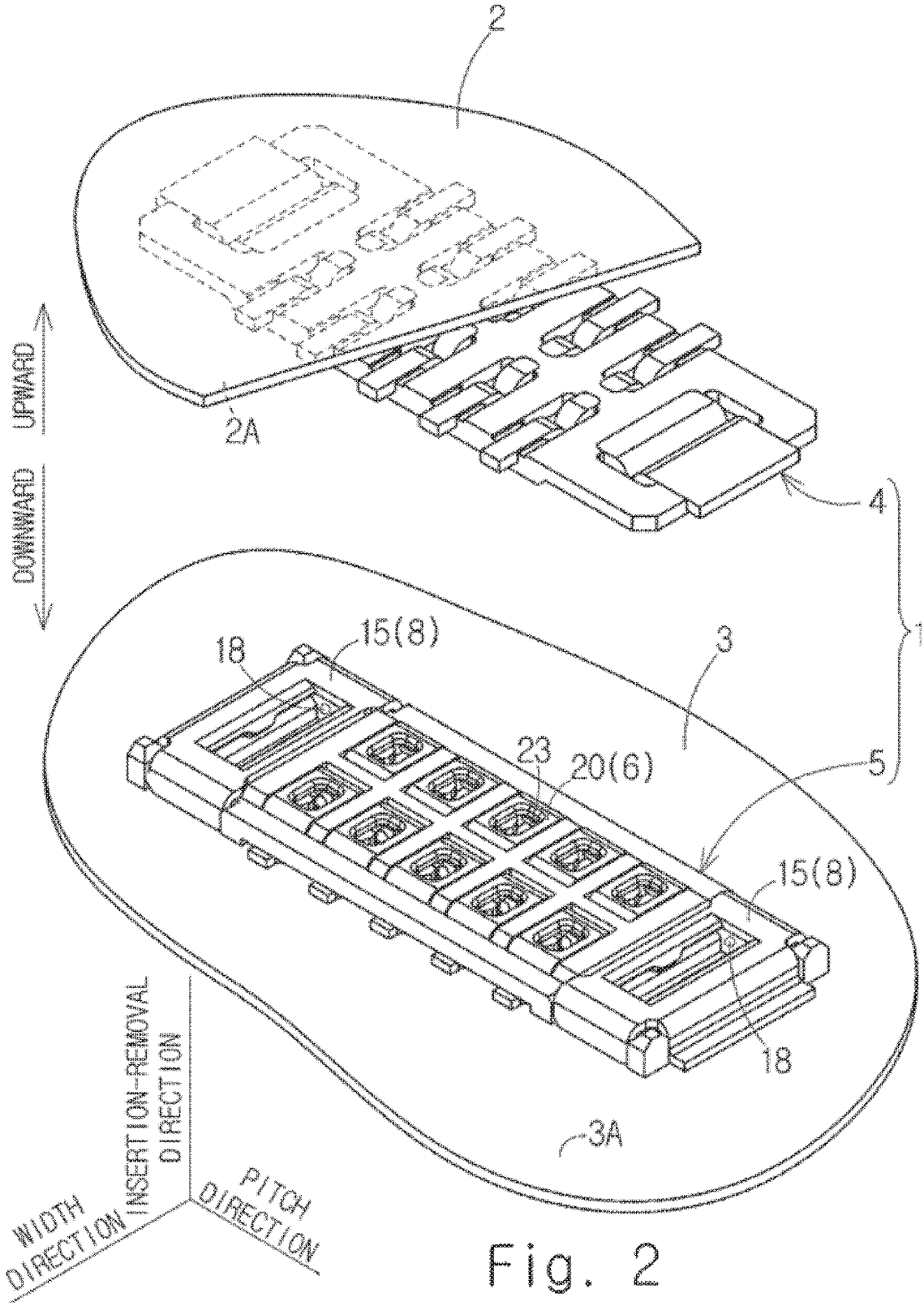
FIG. 2 is a perspective view of the connector assembly before mating (first embodiment)

As shown in FIGS. 1 and 2, a connector assembly 1 is a board-to-board connector that mechanically and electrically connects a plug side board 2 and a receptacle side board 3, and it is composed of a plug connector 4 to be mounted on a connector mounting surface 2A of the plug side board 2 and a receptacle connector 5 to be mounted on a connector mounting surface 3A of the receptacle side board 3.

Figure 3:
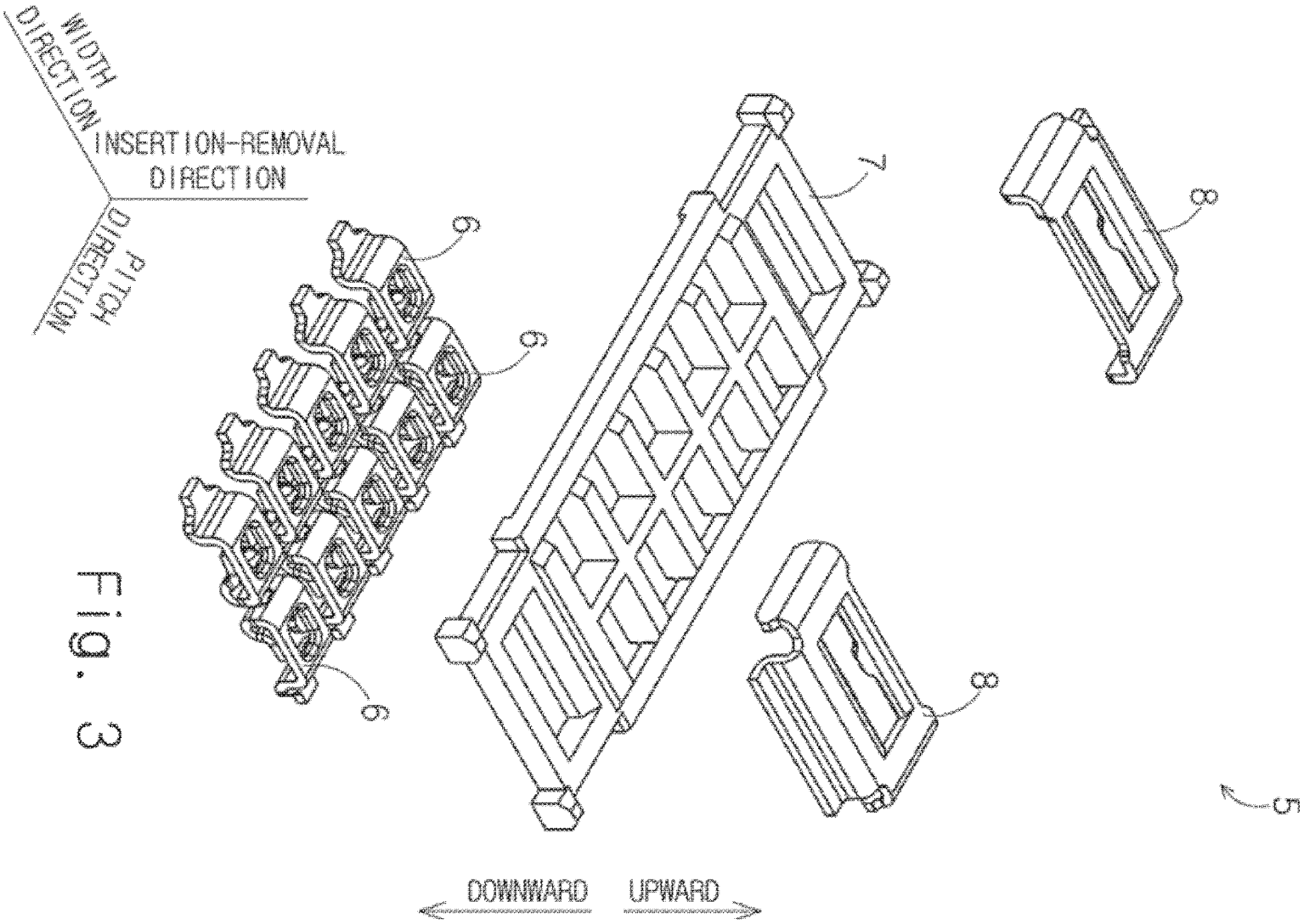
FIG. 3 is an exploded perspective view of a receptacle connector (first embodiment)

As shown in FIG. 3, the receptacle connector 5 includes a plurality of receptacle contacts 6, a receptacle housing 7 that holds the plurality of receptacle contacts 6, and two receptacle hold-downs 8.

The plurality of receptacle contacts 6 are arranged in two rows in the direction parallel to the connector mounting surface 3A of the receptacle side board 3. The two receptacle hold-downs 8 are to fix the receptacle housing 7 to the connector mounting surface 3A of the receptacle side board 3.

The terms "insertion-removal direction", "pitch direction" and "width direction" are defined by referring to FIGS. 1 to 3. The insertion-removal direction, the pitch direction and the width direction are directions that are orthogonal to one another.

The insertion-removal direction is the direction of inserting and removing the plug connector 4 to and from the receptacle connector 5. The insertion-removal direction is the direction orthogonal to the connector mounting surface 2A of the plug side board 2 and the connector mounting surface 3A of the receptacle side board 3. Thus, the insertion-removal direction corresponds to a connector height direction of the plug connector 4 or a connector height direction of the receptacle connector 5. The insertion-removal direction includes upward (removal direction) and downward (mating direction). The upward direction is the direction of removing the plug connector 4 from the receptacle connector 5. The downward direction is the direction of mating the plug connector 4 with the receptacle connector 5. Upward and downward are terms used by way of illustration only and should not be interpreted as limiting the posture of the connector assembly 1 when it is actually used.

The pitch direction is the direction along which the plurality of receptacle contacts 6 are aligned. In the case where the plurality of receptacle contacts 6 are arranged in two rows as in this embodiment, the pitch direction can be defined as the direction along which the plurality of receptacle contacts 6 belonging to one of the two rows are aligned. The pitch direction is the direction parallel to the connector mounting surface 2A of the plug side board 2 and the connector mounting surface 3A of the receptacle side board 3. The pitch direction includes inward and outward in the pitch direction. Inward in the pitch direction is the direction toward the center of the connector assembly 1 in the pitch direction. Outward in the pitch direction is the direction away from the center of the connector assembly 1 in the pitch direction.

The width direction is the direction orthogonal to the insertion-removal direction and the pitch direction. In the case where the plurality of receptacle contacts 6 are arranged in two rows as in this embodiment, the width direction can be defined as the direction along which the two rows are opposed to each other. The width direction is the direction parallel to the connector mounting surface 2A of the plug side board 2 and the connector mounting surface 3A of the receptacle side board 3. The width direction includes inward and outward in the width direction. Inward in the width direction is the direction toward the center of the connector assembly 1 in the width direction. Outward in the width direction is the direction away from the center of the connector assembly 1 in the width direction.

Receptacle Connector 5

The receptacle connector 5 is described hereinafter in detail with reference to FIGS. 3 to 10.

As described above with reference to FIG. 3, the receptacle connector 5 includes the plurality of receptacle contacts 6, the receptacle housing 7 that holds the plurality of receptacle contacts 6, and the two receptacle hold-downs 8.

Receptacle Connector 5: Receptacle Housing 7

Figure 4:
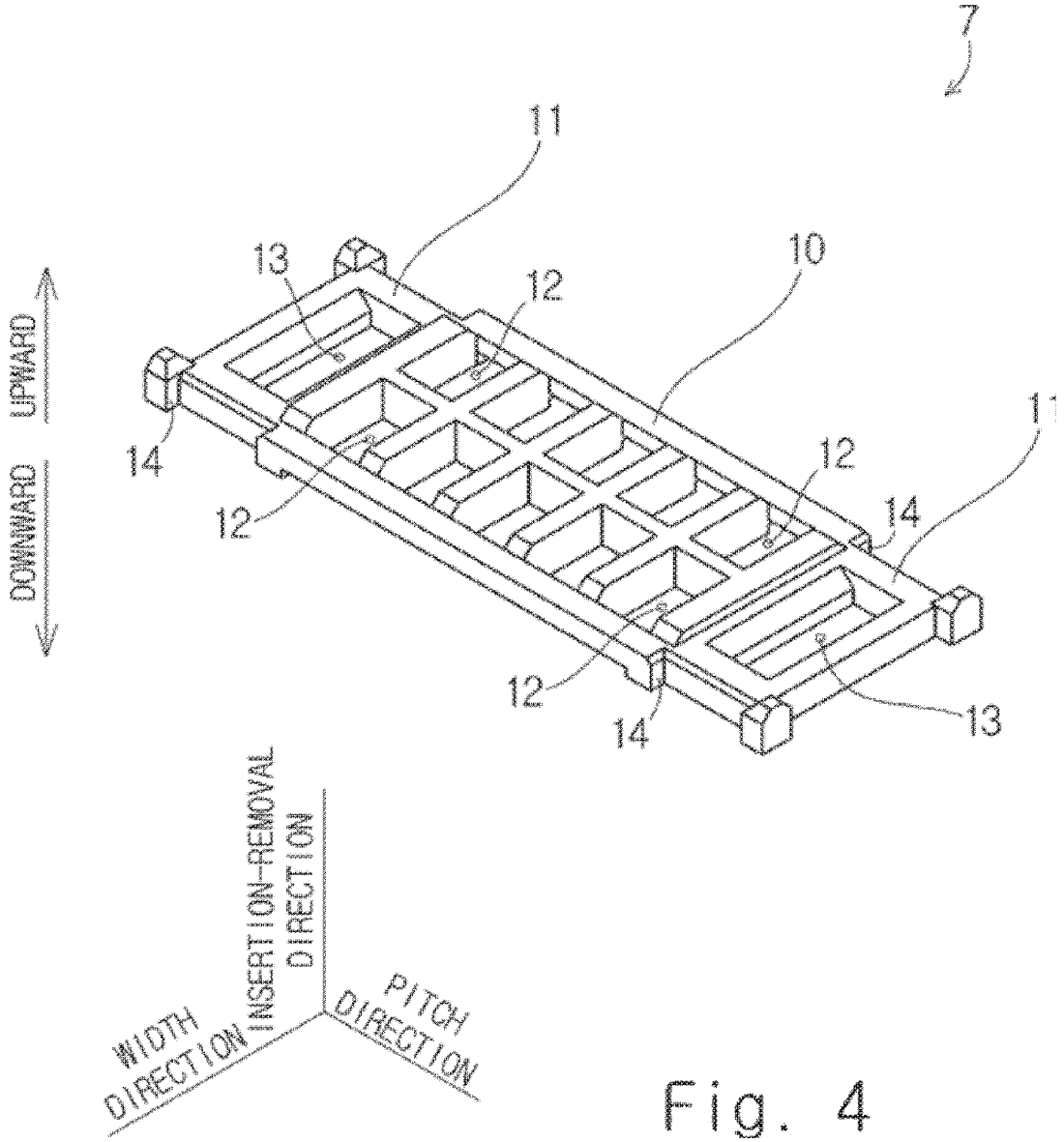
FIG. 4 is a perspective view of a receptacle housing (first embodiment)

As shown in FIG. 4, the receptacle housing 7 is a plate-like member in a rectangular shape when viewed from above, and it is elongated in the pitch direction. The receptacle housing 7 is made of insulating resin, for example.

The receptacle housing 7 includes a receptacle contact holding part 10 that holds the plurality of receptacle contacts 6, and two receptacle hold-down holding parts 11 that respectively hold the two receptacle hold-downs 8.

The receptacle contact holding part 10 has a plurality of receptacle contact accommodation holes 12 that respectively accommodate the plurality of receptacle contacts 6. The plurality of receptacle contact accommodation holes 12 are arranged in two rows so as to correspond to the plurality of receptacle contacts 6.

The two receptacle hold-down holding parts 11 are adjacent to the receptacle contact holding part 10 in the pitch direction. The two receptacle hold-down holding parts 11 are disposed in such a way that the receptacle contact holding part 10 is located between the two receptacle hold-down holding parts 11 in the pitch direction. Each of the receptacle hold-down holding parts 11 has a receptacle hold-down penetrating hole 13 and two receptacle hold-down press-fit grooves 14. The two receptacle hold-down press-fit grooves 14 are formed in such a way that the receptacle hold-down penetrating hole 13 is located between the two receptacle hold-down press-fit grooves 14 in the width direction.

Receptacle Connector 5: Receptacle Hold-Down 8

Figure 5:
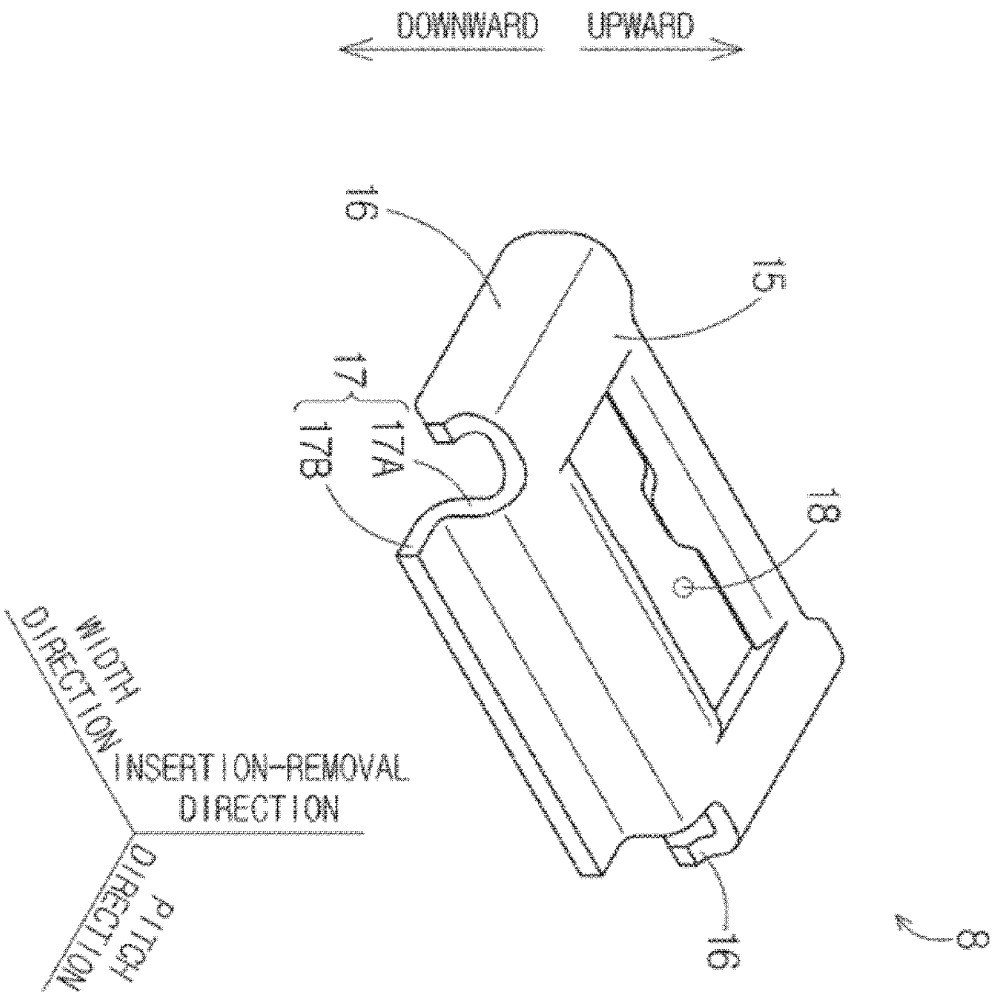
FIG. 5 is a perspective view of a receptacle hold-down (first embodiment)
Figure 6:
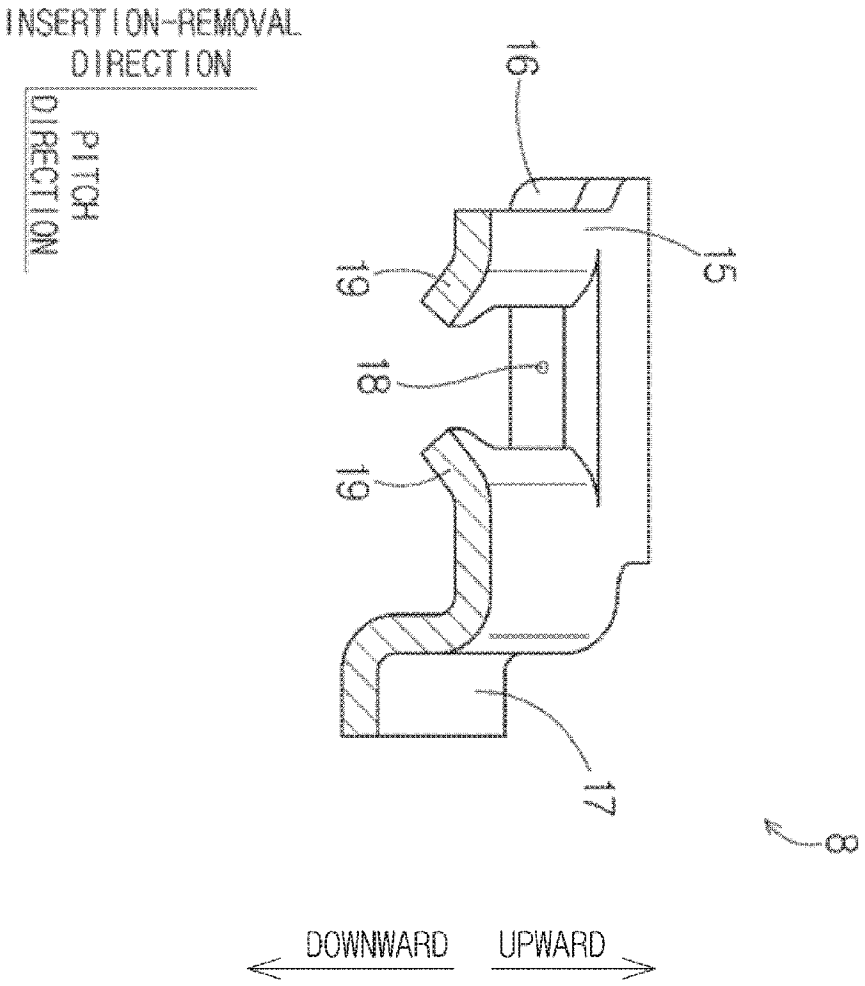
FIG. 6 is a cross-sectional perspective view of the receptacle hold-down (first embodiment)

As described earlier, each of the receptacle hold-downs 8 is to fix the receptacle housing 7 to the connector mounting surface 3A of the receptacle side board 3. As shown in FIGS. 5 and 6, each of the receptacle hold-downs 8 is formed by punching and bending one metal plate. The metal plate is typically made of copper or copper alloy. The receptacle hold-down 8 is preferably tinned before punching and bending or after punching and bending.

As shown in FIG. 5, each of the receptacle hold-downs 8 includes a receptacle hold-down guide part 15, two receptacle hold-down press-fit parts 16, and a receptacle hold-down soldering leg part 17.

The receptacle hold-down guide part 15 is a plate-like member whose thickness direction is parallel to the insertion-removal direction, and it has a receptacle hold-down guide hole 18 that corresponds to the receptacle hold-down penetrating hole 13 of the receptacle hold-down holding part 11 of the receptacle housing 7 shown in FIG. 4. As shown in FIG. 6, the receptacle hold-down guide part 15 has two locking claws 19 that are opposed to each other in the receptacle hold-down guide hole 18.

The two receptacle hold-down press-fit parts 16 are parts to be press-fit to the two receptacle hold-down press-fit grooves 14 of the receptacle hold-down holding part 11 of the receptacle housing 7 shown in FIG. 4. In this embodiment, the receptacle hold-down 8 is fixed to the receptacle housing 7 by press-fitting the two receptacle hold-down press-fit parts 16 into the two receptacle hold-down press-fit grooves 14, respectively. Alternatively, the receptacle hold-down 8 may be fixed to the receptacle housing 7 using an adhesive or may be fastened to the receptacle housing 7, or another method may be used.

The receptacle hold-down soldering leg part 17 includes a soldering leg main part 17A that extends downward from the receptacle hold-down guide part 15, and a soldering part 17B that is able to be soldered onto the connector mounting surface 3A of the receptacle side board 3. By soldering the soldering part 17B onto the connector mounting surface 3A of the receptacle side board 3, the receptacle connector 5 is mounted on the connector mounting surface 3A of the receptacle side board 3.

Receptacle Connector 5: Receptacle Contact 6

Each of the receptacle contacts 6 is described hereinafter in detail with reference to FIGS. 7 to 10.

Figure 7:
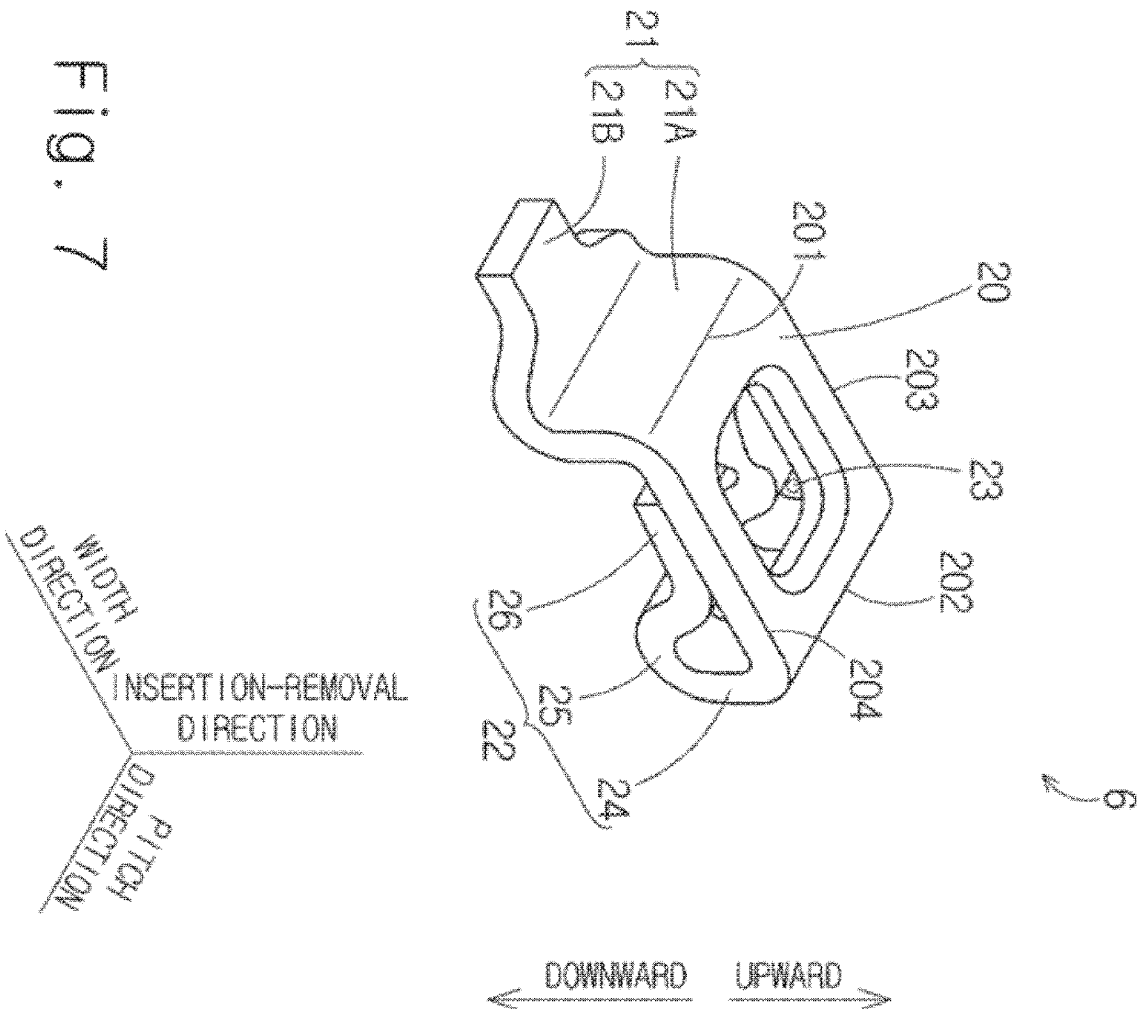
FIG. 7 is a perspective view of a receptacle contact (first embodiment)
Figure 8:
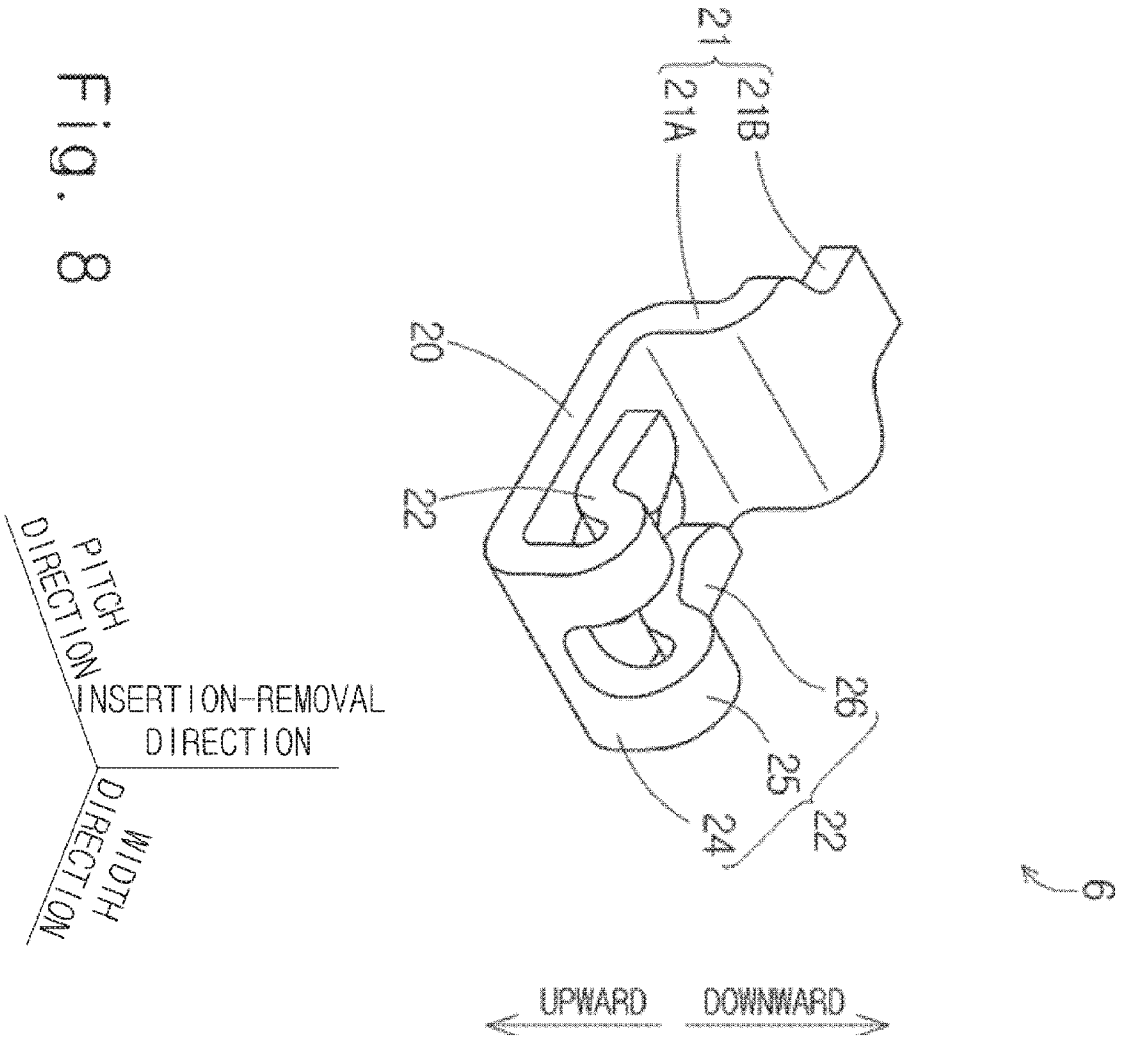
FIG. 8 is a perspective view of the receptacle contact viewed from another angle (first embodiment)
Figure 9:
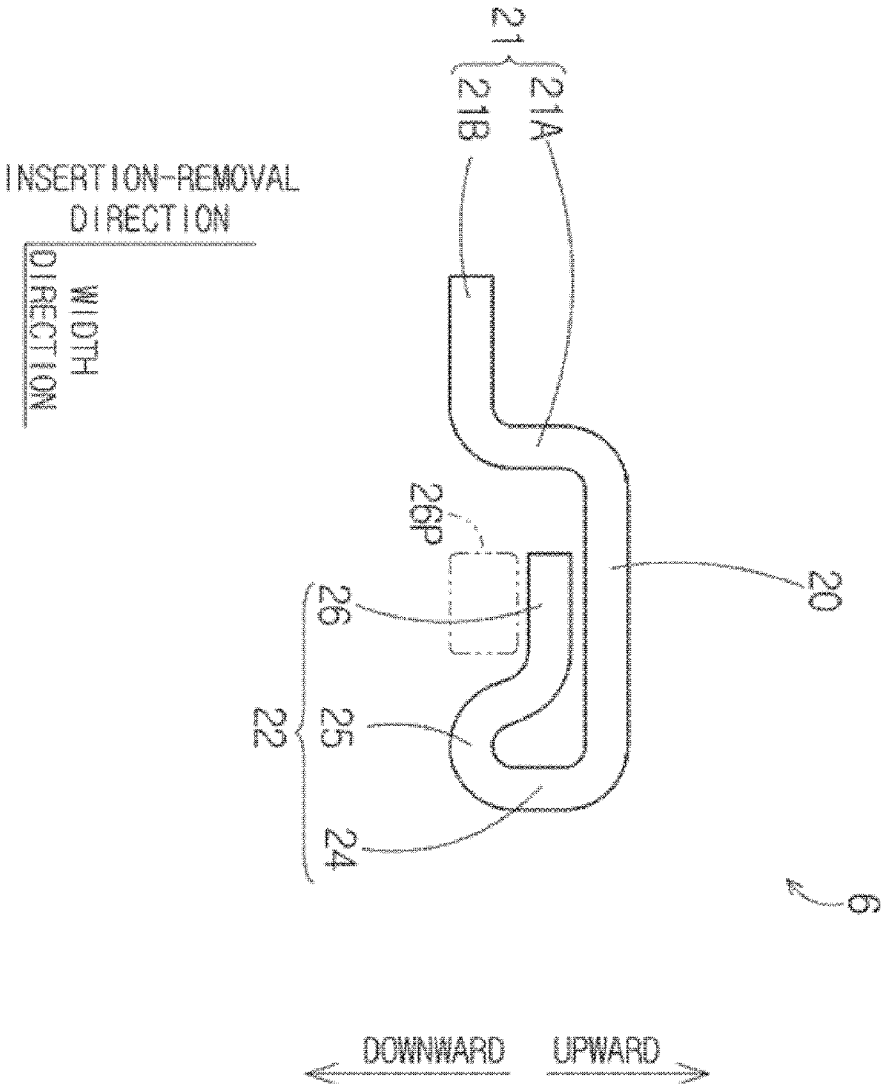
FIG. 9 is a side view of the receptacle contact (first embodiment)

As shown in FIGS. 7 to 9, each of the receptacle contacts 6 is formed by punching and bending one metal plate. The metal plate is typically made of copper or copper alloy. Each of the receptacle contacts 6 is preferably tinned before punching and bending or after punching and bending.

As shown in FIGS. 7 to 9, each of the receptacle contacts 6 is symmetric with respect to a line in the width direction, and it includes a receptacle contact guide part 20 (guide part), a soldering leg part 21, and two spring pieces 22.

The receptacle contact guide part 20 is a plate-like member in a rectangular shape when viewed from above, whose thickness direction is parallel to the insertion-removal direction. The receptacle contact guide part 20 has a first side 201 and a second side 202 that are opposed to each other in the width direction, and a third side 203 and a fourth side 204 that are opposed to each other in the pitch direction. The first side 201 and the second side 202 are disposed in this recited order inwardly in the width direction. A receptacle contact guide hole 23 (guide hole) is formed between the first side 201 and the second side 202. The receptacle contact guide hole 23 is a penetrating hole that penetrates the receptacle contact guide part 20 in the insertion-removal direction.

The soldering leg part 21 extends downward from the first side 201. The soldering leg part 21 includes a soldering leg main part 21A and a soldering part 21B. The soldering leg main part 21A extends downward from the first side 201. The soldering part 21B extends outward in the width direction from the lower end of the soldering leg main part 21A. The soldering part 21B is soldered onto an electrode, which is not shown, on the connector mounting surface 3A of the receptacle side board 3.

The two spring pieces 22 are disposed under the receptacle contact guide part 20. The two spring pieces 22 are supported like a cantilever beam by the receptacle contact guide part 20. The two spring pieces 22 extend like a cantilever beam from the second side 202 of the receptacle contact guide part 20. The two spring pieces 22 are disposed slightly apart from each other in the pitch direction.

As shown in FIG. 9, each of the spring pieces 22 includes a first extension part 24, a curve part 25, and a second extension part 26.

The first extension part 24 is a part that extends downward from the second side 202 of the receptacle contact guide part 20.

The curve part 25 is a part that extends outward in the width direction from the lower end of the first extension part 24, and it curves to be convex downward. Thus, the curve part 25 is in a U-shape that opens upward.

The second extension part 26 is a part that extends outward in the width direction from the curve part 25. Below the second extension part 26 is a deformation space 26P for each spring piece 22 to be elastically deformed downward.

Figure 10:
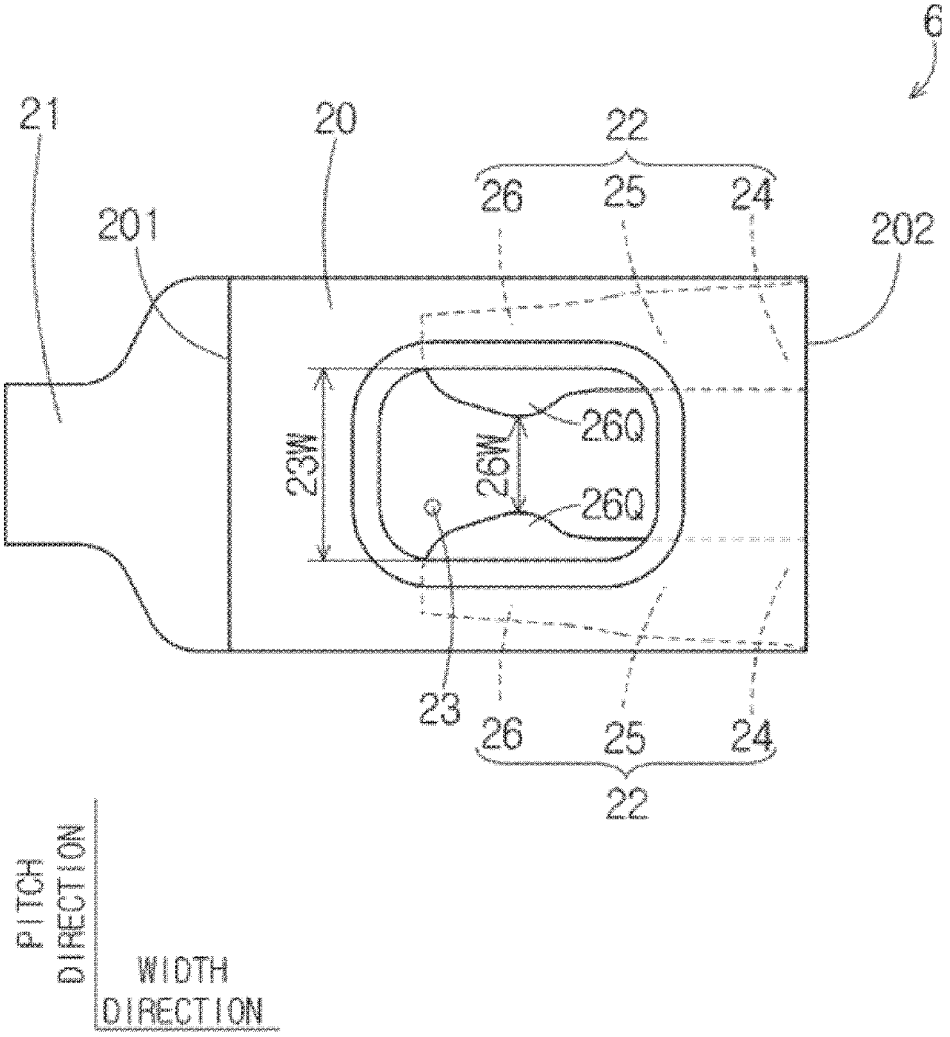
FIG. 10 is a plan view of the receptacle contact (first embodiment)

As shown in FIG. 10, the two spring pieces 22 extend to come closer to each other as they go outward in the width direction when viewed from above.

The second extension part 26 of one spring piece 22 of the two spring pieces 22 has a contact part 26Q that projects toward the second extension part 26 of the other spring piece 22. The same applies to the other one. In the state before the mating of the connector assembly 1, a separation distance 26W between the contact parts 26Q of the two spring pieces 22 in the pitch direction is smaller than a dimension 23W of the receptacle contact guide hole 23 in the pitch direction. Thus, the contact parts 26Q of the second extension part 26 of the two spring pieces 22 are visible through the receptacle contact guide hole 23 when viewed from above.

In this embodiment, each receptacle contact 6 is fixed by press-fitting to each receptacle contact accommodation hole 12 of the receptacle housing 7. Alternatively, each receptacle contact 6 may be fixed to each receptacle contact accommodation hole 12 of the receptacle housing 7 by insert molding or using an adhesive, may be fastened to the receptacle contact accommodation hole 12, or another method may be used.

Plug Connector 4

The plug connector 4 is described hereinafter in detail with reference to FIGS. 11 to 15. It should be noted that, since the posture of the plug connector 4 relative to the receptacle connector 5 in the state where the plug connector 4 is mated with the receptacle connector 5 is uniquely defined, the directions defined based on the receptacle side board 3 and the receptacle connector 5 are used without change in the following description of the plug connector 4.

Figure 11:
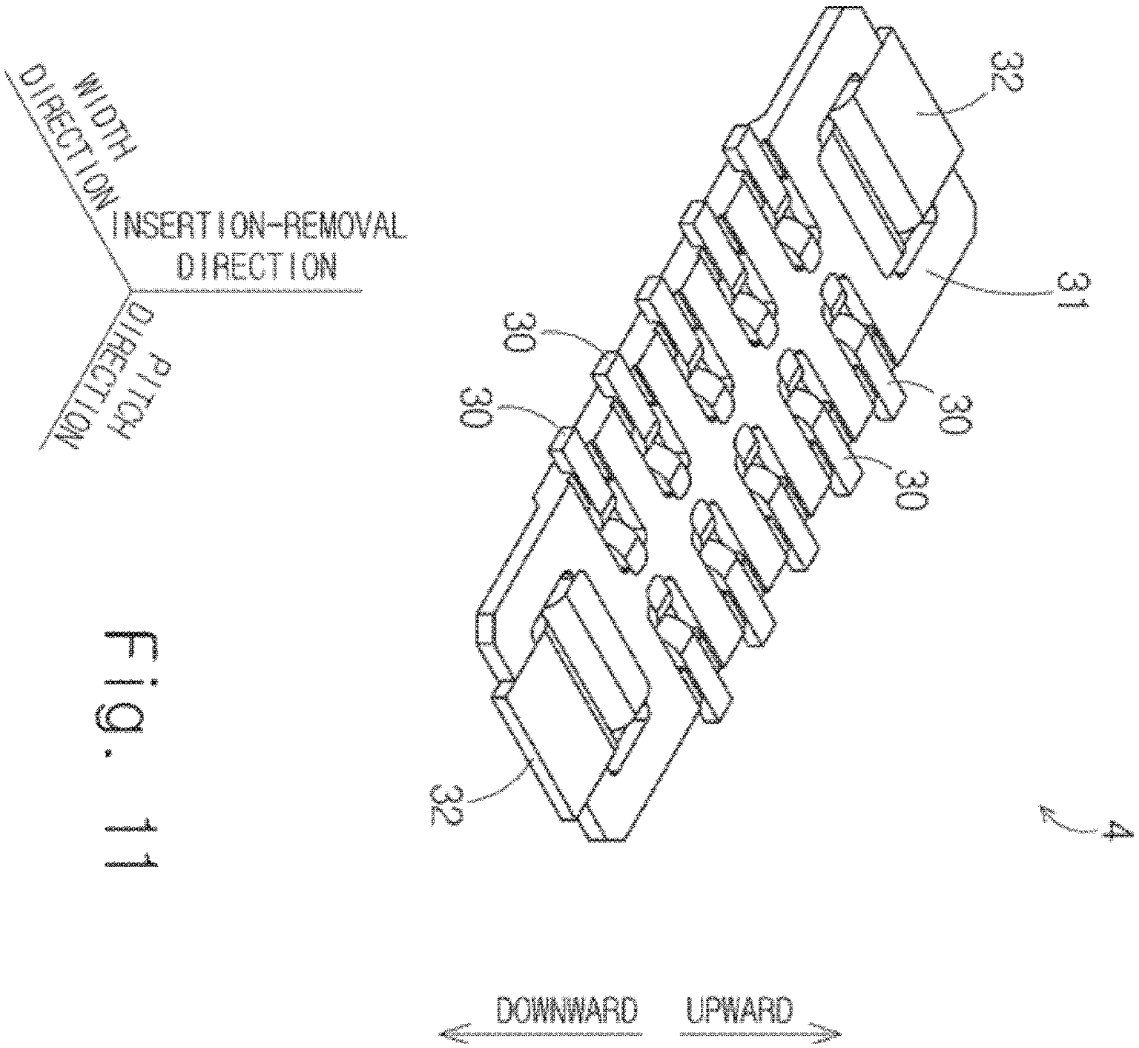
FIG. 11 is a perspective view of a plug connector (first embodiment)
Figure 12:
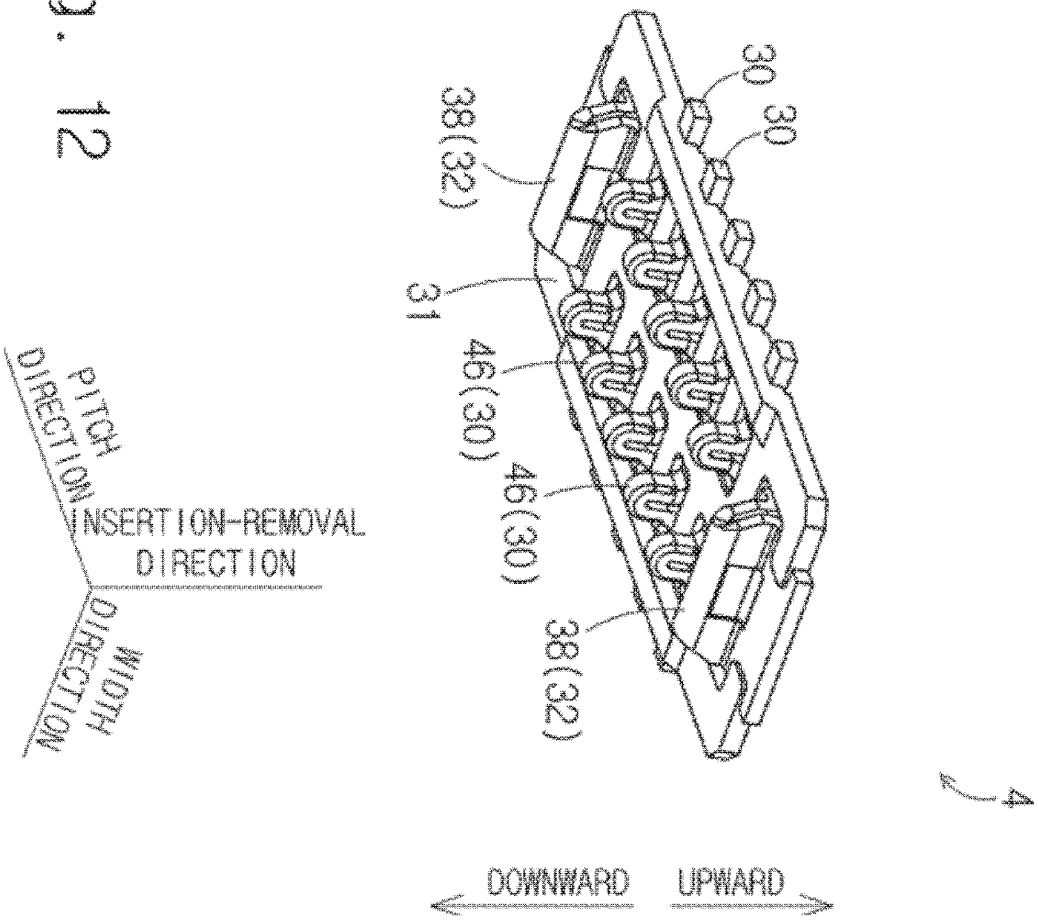
FIG. 12 is a perspective view of the plug connector viewed from another angle (first embodiment)
Figure 13:
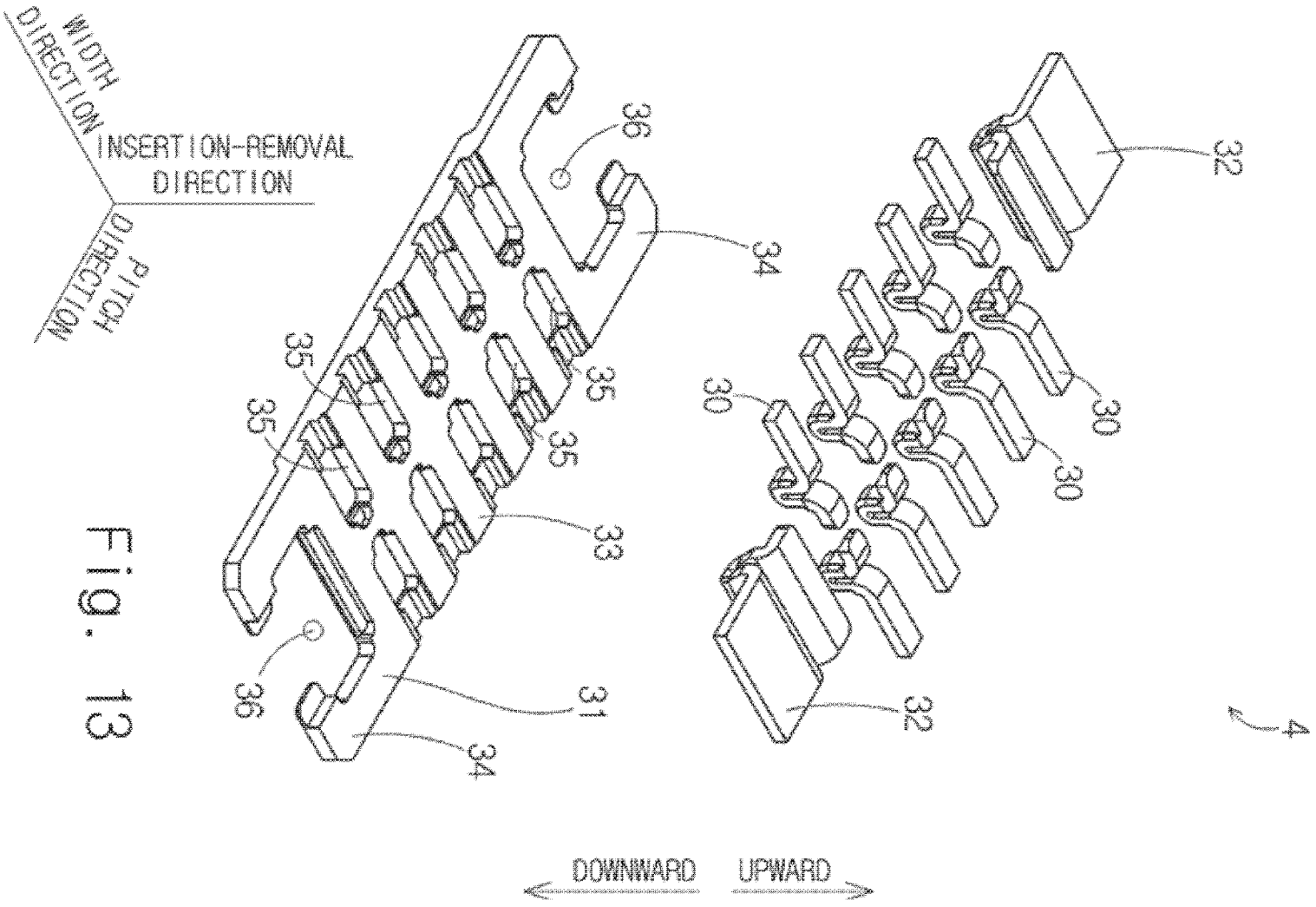
FIG. 13 is an exploded perspective view of the plug connector (first embodiment)

As shown in FIGS. 11 to 13, the plug connector 4 includes a plurality of plug contacts 30, a plug housing 31 that holds the plurality of plug contacts 30, and two plug hold-downs 32.

The plurality of plug contacts 30 are arranged in two rows in the direction parallel to the connector mounting surface 2A of the plug side board 2. The two plug hold-downs 32 are to fix the plug housing 31 to the connector mounting surface 2A of the plug side board 2.

Plug Connector 4: Plug Housing 31

As shown in FIG. 13, the plug housing 31 is a plate-like member in a rectangular shape when viewed from above, and it is elongated in the pitch direction.

The plug housing 31 is made of insulating resin, for example. The plug housing 31 includes a plug contact holding part 33 that holds the plurality of plug contacts 30, and two plug hold-down holding parts 34 that respectively hold the two plug hold-downs 32.

The plug contact holding part 33 has a plurality of plug contact accommodation holes 35 that respectively accommodate the plurality of plug contacts 30. The plurality of plug contact accommodation holes 35 are arranged in two rows so as to correspond to the plurality of plug contacts 30.

The two plug hold-down holding parts 34 are adjacent to the plug contact holding part 33 in the pitch direction. The two plug hold-down holding parts 34 are disposed in such a way that the plug contact holding part 33 is located between the two plug hold-down holding parts 34. Each of the plug hold-down holding parts 34 has a hold-down accommodation cutout 36.

Plug Connector 4: Plug Hold-Down 32

Figure 14:
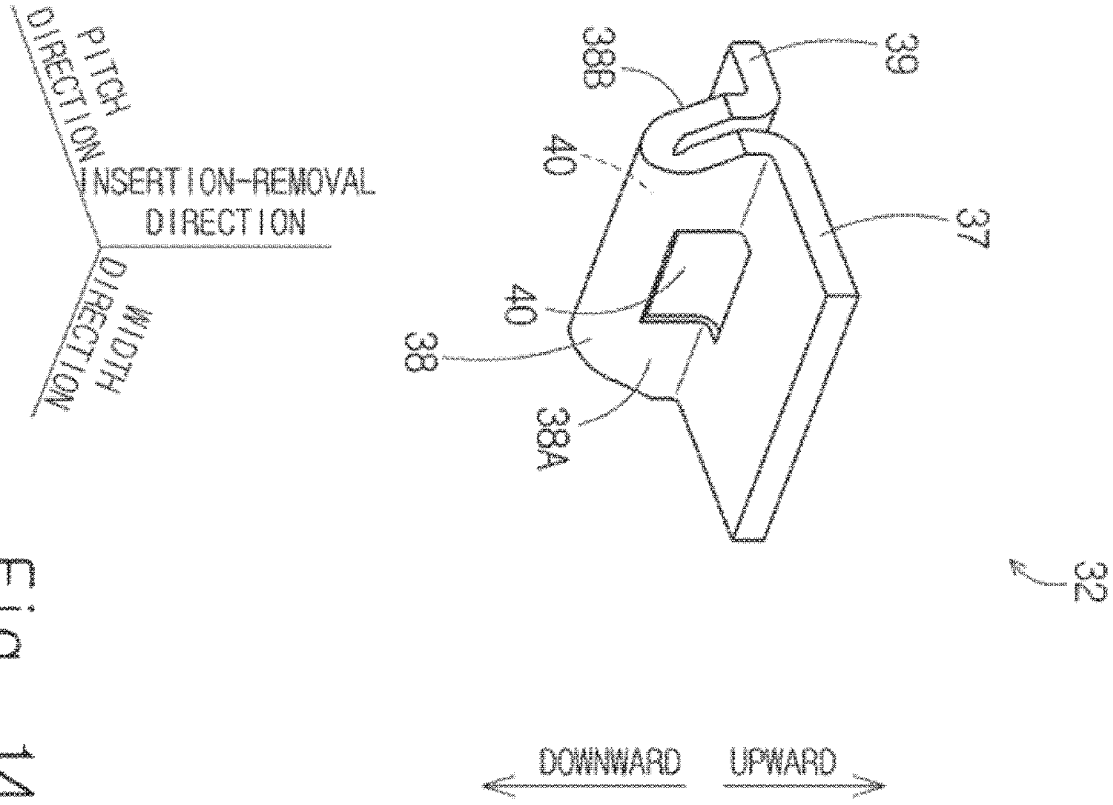
FIG. 14 is a perspective view of a plug hold-down (first embodiment)

As described earlier, each of the plug hold-downs 32 is to fix the plug housing 31 to the connector mounting surface 2A of the plug side board 2. As shown in FIG. 14, each of the plug hold-downs 32 is formed by punching and bending one metal plate. The metal plate is typically made of copper or copper alloy. Each of the plug hold-downs 32 is preferably tinned before punching and bending or after punching and bending.

Each of the plug hold-downs 32 includes a soldering part 37, a U-shaped projecting part 38, and a posture stabilization part 39. The soldering part 37, the U-shaped projecting part 38, and the posture stabilization part 39 are disposed in this recited order inwardly in the width direction.

The soldering part 37 is a plate-like member whose thickness direction is parallel to the insertion-removal direction, which is able to be soldered onto the connector mounting surface 2A of the plug side board 2.

The U-shaped projecting part 38 is a part that curves to be convex downward in a U-shape, and it has an outer engagement surface 38A that faces outward in the pitch direction and an inner engagement surface 38B that faces inward in the pitch direction. The outer engagement surface 38A has a locking claw engagement recess 40. The locking claw 19 shown in FIG. 6 catches on the locking claw engagement recess 40, and thereby the locking claw engagement recess 40 in cooperation with the locking claw 19 exerts a locking force to maintain the mated state of the connector assembly 1. The inner engagement surface 38B also has a locking claw engagement recess.

The posture stabilization part 39 is a plate-like member whose thickness direction is parallel to the insertion-removal direction.

In this embodiment, each plug hold-down 32 is fixed to the hold-down accommodation cutout 36 of each plug hold-down holding part 34 of the plug housing 31 by insert molding. Alternatively, each plug hold-down 32 may be fixed to the hold-down accommodation cutout 36 of each plug hold-down holding part 34 of the plug housing 31 by press-fitting or using an adhesive or may be fastened to the plug housing 31, or another method may be used.

Plug Connector 4: Plug Contact 30

Each of the plug contacts 30 is described hereinafter in detail with reference to FIG. 15.

Figure 15:
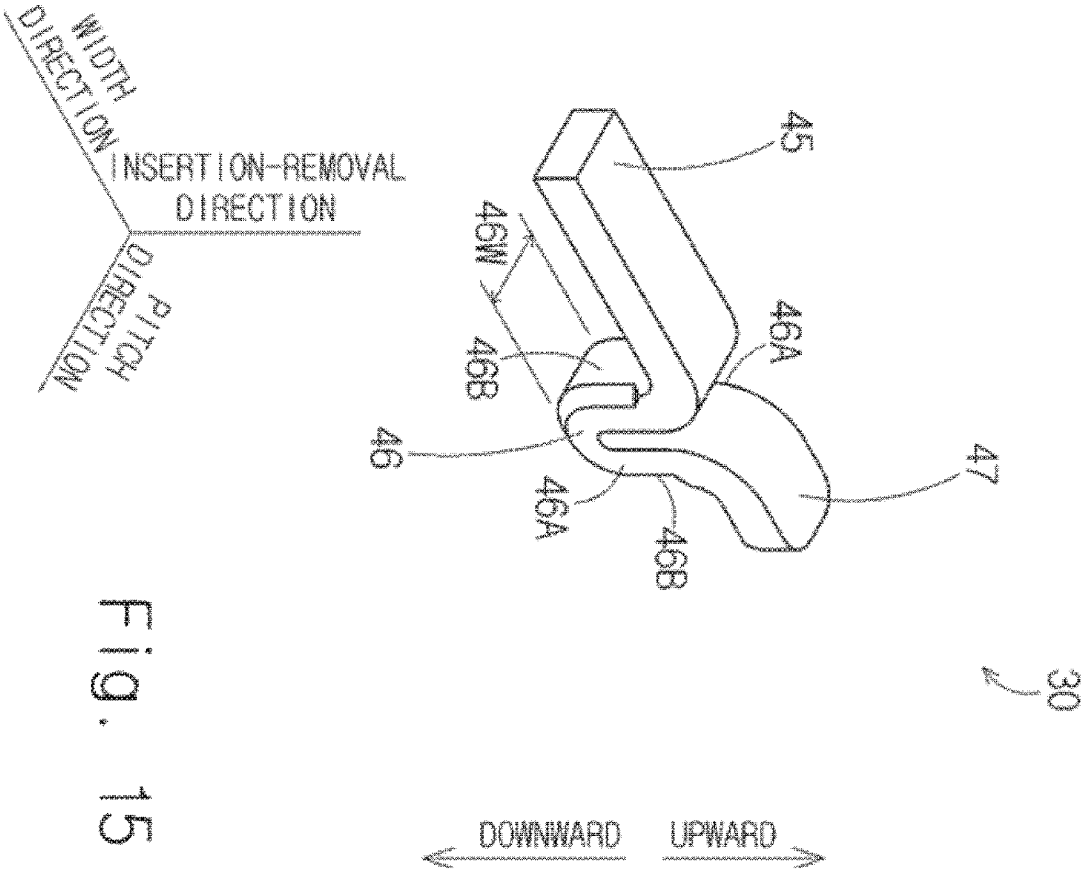
FIG. 15 is a perspective view of a plug contact (first embodiment)

As shown in FIG. 15, the plug contact 30 is formed by punching and bending one metal plate. The metal plate is typically made of copper or copper alloy. Each plug contact 30 is preferably tinned before punching and bending or after punching and bending.

The plug contact 30 includes a soldering part 45, a U-shaped projecting part 46, and a posture stabilization part 47.

The soldering part 45 is a plate-like member whose thickness direction is parallel to the insertion-removal direction, and it is soldered onto an electrode, which is not shown, on the connector mounting surface 2A of the plug side board 2.

The U-shaped projecting part 46 is a part that curves to be convex downward in a U-shape, and it has two pitch contact surfaces 46A that face the pitch direction and two width contact surfaces 46B that face the width direction.

One of the two pitch contact surfaces 46A faces outward in the pitch direction, and the other one faces inward in the pitch direction.

One of the two width contact surfaces 46B faces inward in the width direction, and the other one faces outward in the width direction.

A dimension 46W in the pitch direction of the U-shaped projecting part 46 is larger than the separation distance 26W and smaller than the dimension 23W shown in FIG. 10.

Referring back to FIG. 15, the posture stabilization part 47 is a plate-like member whose thickness direction is parallel to the insertion-removal direction.

In this embodiment, each plug contact 30 is fixed to each plug contact accommodation hole 35 of the plug contact holding part 33 of the plug housing 31 by insert molding. Alternatively, each plug contact 30 may be fixed to each plug contact accommodation hole 35 by press-fitting or using an adhesive or may be fastened to the plug housing 31, or another method may be used.

Mating Operation of Connector Assembly 1

A mating operation of the connector assembly 1 is described hereinafter.

First, to mate the plug connector 4 mounted on the connector mounting surface 2A of the plug side board 2 with the receptacle connector 5 mounted on the connector mounting surface 3A of the receptacle side board 3, the plug connector 4 and the receptacle connector 5 are placed opposed to each other in the insertion-removal direction as shown in FIG. 2.

Next, the plug connector 4 is shifted downward toward the receptacle connector 5. Then, the U-shaped projecting part 46 of each plug contact 30 of the plug connector 4 shown in FIG. 12 comes into contact with the receptacle contact guide part 20 of each receptacle contact 6 shown in FIG. 2. At the same time, the U-shaped projecting part 38 of each plug hold-down 32 shown in FIG. 12 comes into contact with the receptacle hold-down guide part 15 of each receptacle hold-down 8 shown in FIG. 2.

In this state, the plug connector 4 is shaken in the pitch direction and in the width direction relative to the receptacle connector 5 while the plug connector 4 is pressed against the receptacle connector 5. Then, the U-shaped projecting part 46 of each plug contact 30 shown in FIG. 12 is inserted into the receptacle contact guide hole 23 of the receptacle contact guide part 20 of each receptacle contact 6 shown in FIG. 2. The direction in which the U-shaped projecting part 46 of each plug contact 30 shown in FIG. 12 is inserted into the receptacle contact guide hole 23 of the receptacle contact guide part 20 of each receptacle contact 6 shown in FIG. 2 corresponds to the downward direction. At the same time, the U-shaped projecting part 38 of each plug hold-down 32 shown in FIG. 12 is inserted into the receptacle hold-down guide hole 18 of the receptacle hold-down guide part 15 of each receptacle hold-down 8 shown in FIG. 2.

When the U-shaped projecting part 38 of each plug hold-down 32 shown in FIG. 12 is inserted into the receptacle hold-down guide hole 18 of the receptacle hold-down guide part 15 of each receptacle hold-down 8 shown in FIG. 2, the two locking claws 19 of each receptacle hold-down 8 shown in FIG. 6 catch on the two locking claw engagement recesses 40 of each plug hold-down 32 shown in FIG. 14. Each locking claw 19 and each locking claw engagement recess 40 thereby cooperate to exert a locking force to maintain the mated state of the connector assembly 1.

Figure 16:
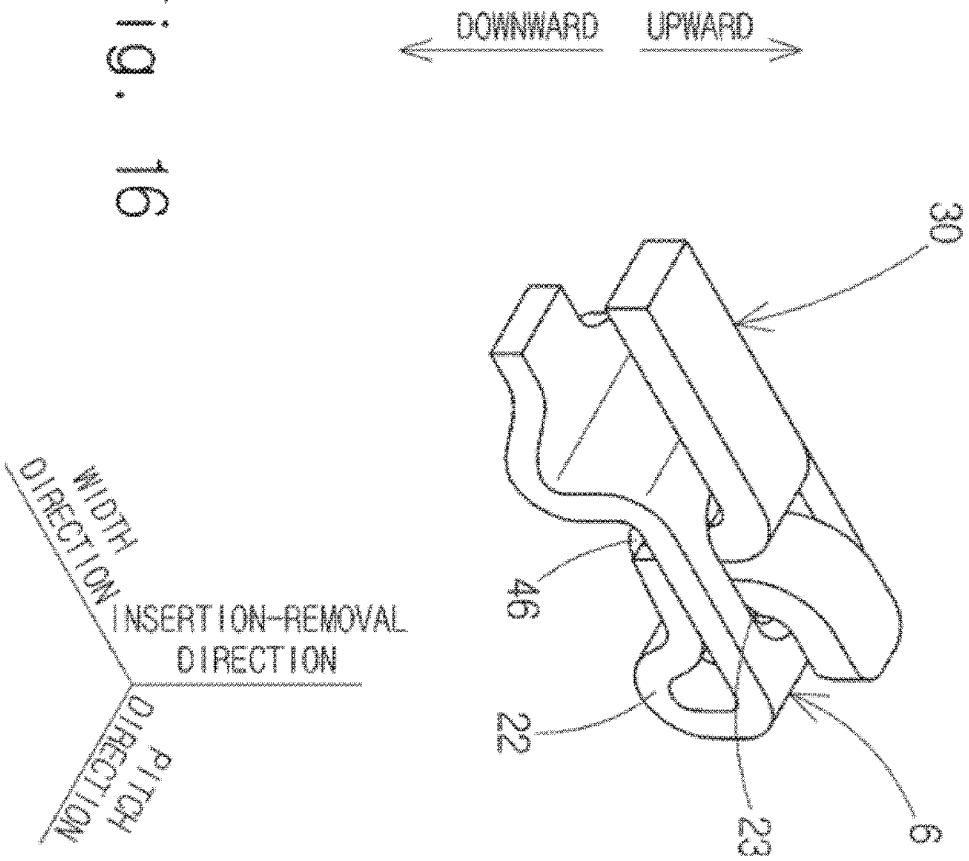
FIG. 16 is a perspective view of the receptacle contact and the plug contact in the connector assembly in a mated state (first embodiment)

On the other hand, when the U-shaped projecting part 46 of each plug contact 30 shown in FIG. 12 is inserted into the receptacle contact guide hole 23 of the receptacle contact guide part 20 of each receptacle contact 6 shown in FIG. 2, the U-shaped projecting part 46 of each plug contact 30 shown in FIG. 12 is inserted between the two spring pieces 22 of each receptacle contact 6 shown in FIG. 10. FIG. 16 shows the state where the U-shaped projecting part 46 of each plug contact 30 is inserted between the two spring pieces 22 of each receptacle contact 6.

When the U-shaped projecting part 46 of each plug contact 30 shown in FIG. 12 is inserted between the second extension parts 26 of the two spring pieces 22 of each receptacle contact 6 shown in FIG. 10, the two spring pieces 22 are pushed away in the pitch direction by the U-shaped projecting part 46, and consequently the two spring pieces 22 are elastically deformed in the direction of separating from each other. By a spring restoring force caused by this elastic deformation, the contact parts 26Q of the second extension parts 26 of the two spring pieces 22 shown in FIG. 10 respectively come into contact with the two pitch contact surfaces 46A of the U-shaped projecting part 46 of each plug contact 30 shown in FIG. 15. Each plug contact 30 and each receptacle contact 6 thereby come into electrical contact with each other.

Removal Operation of Connector Assembly 1

A removal operation of the connector assembly 1 is described hereinafter.

To remove the plug connector 4 from the receptacle connector 5, the plug connector 4 is pulled out upward from the receptacle connector 5 with a force exceeding the above-described locking force. After the plug connector 4 is removed from the receptacle connector 5, the two spring pieces 22 of the receptacle contact 6 shown in FIG. 10 elastically return to the unloaded condition shown in the figure.

The first embodiment is described above. The above-described first embodiment has the following features.

As shown in FIGS. 1 to 3 and 13, the connector assembly 1 includes the plug connector 4 which includes the plurality of plug contacts 30 and the plug housing 31 that holds the plurality of plug contacts 30 and which is able to be mounted on the plug side board 2, and the receptacle connector 5 which includes the plurality of receptacle contacts 6 and the receptacle housing 7 that holds the plurality of receptacle contacts 6 and which is able to be mounted on the receptacle side board 3. As shown in FIGS. 1, 2 and 16, each plug contact 30 comes into electrical contact with each receptacle contact 6 by mating the plug connector 4 and the receptacle connector 5.

As shown in FIGS. 7 to 10, each receptacle contact 6 includes the receptacle contact guide part 20 (guide part) that has the receptacle contact guide hole 23 (guide hole) into which each plug contact 30 can be inserted in the direction toward the receptacle side board 3, and the two spring pieces 22 that are elastically deformed when each plug contact 30 is inserted into the receptacle contact guide hole 23. The two spring pieces 22 come into contact with each plug contact 30 that is inserted into the receptacle contact guide hole 23 by a spring restoring force. In this structure, a simple mating operation is achieved. Further, because the receptacle contact guide part 20 and the two spring pieces 22 belong to the same receptacle contact 6, no problem arises when each plug contact 30 is in contact with the receptacle contact guide part 20 in the state where the plug connector 4 and the receptacle connector 5 are mated together.

Further, because the receptacle contact guide part 20 is made of metal, the receptacle contact guide part 20 is less subject to damage when inserting the U-shaped projecting part 46 of each plug contact 30 shown in FIG. 12 into the receptacle contact guide hole 23 of each receptacle contact 6 shown in FIG. 2.

Note that, in this embodiment, the downward direction is one specific example of the above-described "direction toward the receptacle side board 3". The "direction toward the receptacle side board 3" is one specific example of a connector height direction or the insertion-removal direction.

In this embodiment, the receptacle contact 6 includes the two spring pieces 22. However, the receptacle contact 6 may include one or three or more spring pieces 22, for example.

Further, as shown in FIG. 7, the receptacle contact guide part 20 and the two spring pieces 22 are disposed in this recited order in the downward direction (the insertion direction of inserting each plug contact 30 into the receptacle contact guide hole 23). To be more simple, the two spring pieces 22 are disposed under the receptacle contact guide part 20. In this structure, the two spring pieces 22 are protected before the mating of the connector assembly 1 because the two spring pieces 22 are covered with the receptacle contact guide part 20 in the state where the receptacle connector 5 is mounted on the receptacle side board 3.

Further, as shown in FIG. 7, the two spring pieces 22 are a cantilever beam. In this structure, the two spring pieces 22 are easily elastically deformed.

Further, as shown in FIG. 7, each receptacle contact 6 has two leg parts that project from the receptacle contact guide part 20 in the downward direction (the insertion direction of inserting each plug contact 30 into the receptacle contact guide hole 23). In this embodiment, one of the two leg parts is the soldering leg main part 21A of the soldering leg part 21, and the other one is the first extension part 24 of each spring piece 22. The two leg parts are disposed in such a way that the receptacle contact guide hole 23 is located between the two leg parts. This structure prevents deformation of each receptacle contact 6 that occurs when each plug contact 30 hit the receptacle contact guide part 20 while inserting each plug contact 30 into the receptacle contact guide hole 23.

Note that each receptacle contact 6 may have at least one leg part that projects from the receptacle contact guide part 20 in the downward direction (the insertion direction of inserting each plug contact 30 into the receptacle contact guide hole 23). In this case also, the structure prevents deformation of each receptacle contact 6 that occurs when each plug contact 30 hit the receptacle contact guide part 20 while inserting each plug contact 30 into the receptacle contact guide hole 23.

Further, as shown in FIG. 16, each plug contact 30 that is inserted into the receptacle contact guide hole 23 is configured to be inserted between the two spring pieces 22. The two spring pieces 22 come into contact with each plug contact 30 that is inserted into the receptacle contact guide hole 23 by a spring restoring force. In this structure, the spring restoring forces of the two spring pieces 22 act on each plug contact 30 in such a way that they cancel out each other, and thereby the position of each plug contact 30 in the mated state of the connector assembly 1 is stabilized.

Further, as shown in FIG. 7, the receptacle contact guide part 20 is in a rectangular shape having the first side 201 and the second side 202 parallel to each other, and the receptacle contact guide hole 23 is formed between the first side 201 and the second side 202 when viewed in the downward direction (the insertion direction of inserting each plug contact 30 into the receptacle contact guide hole 23). Each receptacle contact 6 further includes the soldering leg part 21 that extends downward (in the insertion direction) from the first side 201 and includes the soldering part 21B that is able to be soldered onto the receptacle side board 3. The two spring pieces 22 extend like a cantilever beam from the second side 202.

Second Embodiment

A second embodiment is described hereinafter with reference to FIGS. 17 and 18. Hereinafter, differences of this embodiment from the first embodiment are mainly described, and redundant description is omitted.

In the above-described first embodiment, the two spring pieces 22 of the receptacle contact 6 extend from the second side 202 of the receptacle contact guide part 20 as shown in FIG. 7, for example.

Figure 17:
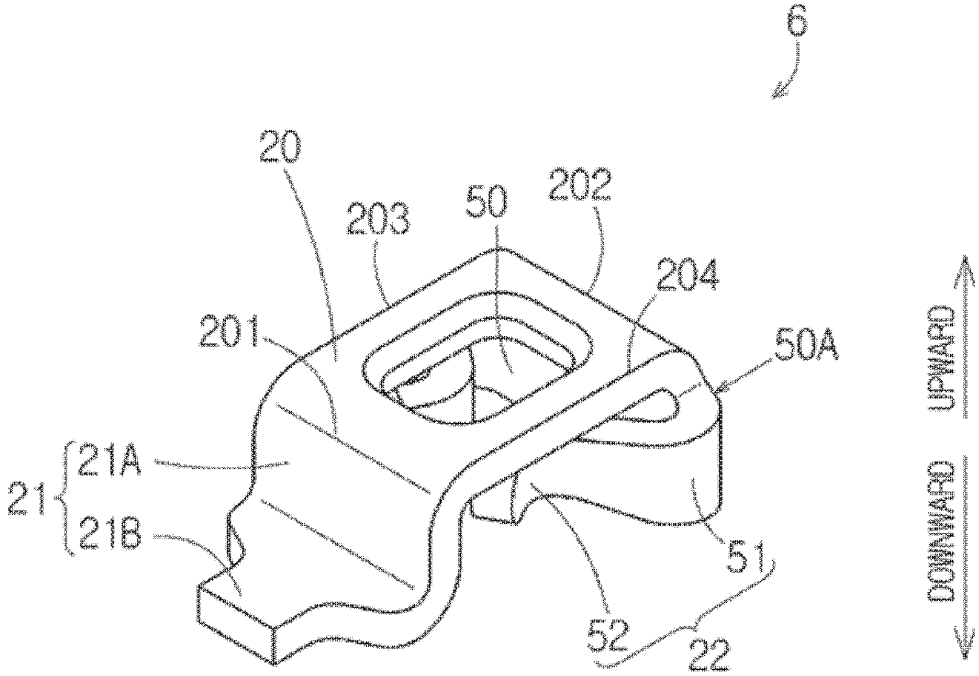
FIG. 17 is a perspective view of a receptacle contact (second embodiment)
Figure 17:
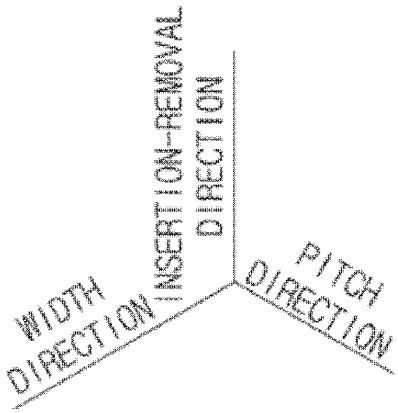
Figure 18:
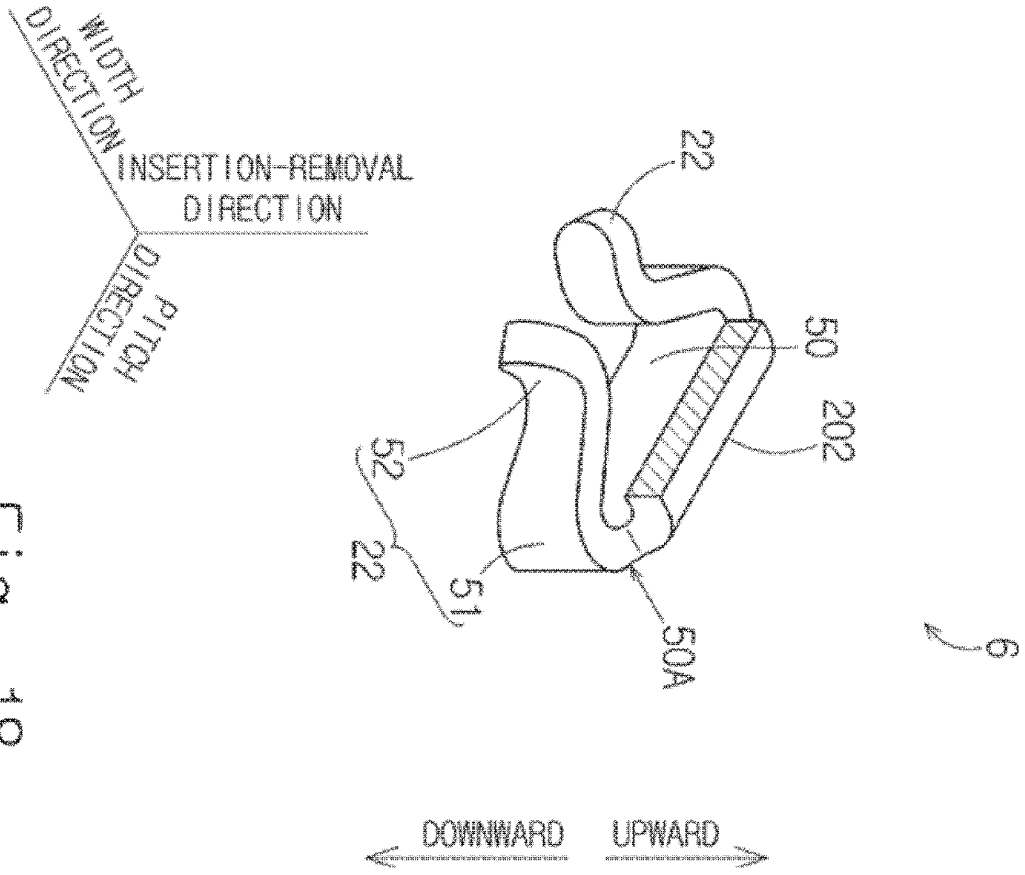
FIG. 18 is a partially cutout perspective view of the receptacle contact (second embodiment)

On the other hand, the receptacle contact 6 according to this embodiment further includes a support leg part 50 (leg part) that extends downward from the second side 202 of the receptacle contact guide part 20 as shown in FIGS. 17 and 18. The two spring pieces 22 respectively extend like a cantilever beam from two side edges 50A in the pitch direction of the support leg part 50.

To be specific, each spring piece 22 has a first curve part 51 that extends outward in the width direction from each side edge 50A of the support leg part 50 and a second curve part 52 that extends outward in the width direction from the first curve part 51.

The first curve part 51 of one spring piece 22 curves to be convex in the direction of separating from the other spring piece 22 in the pitch direction. The same applies to the other one.

The second curve part 52 of one spring piece 22 curves to be convex in the direction of approaching the other spring piece 22 in the pitch direction. The same applies to the other one.

Thus, each spring piece 22 curves in an S-shape when viewed from above.

Third Embodiment

A third embodiment is described hereinafter with reference to FIGS. 19 and 20. Hereinafter, differences of this embodiment from the first embodiment are mainly described, and redundant description is omitted.

In the above-described first embodiment, the two spring pieces 22 of the receptacle contact 6 extend from the second side 202 of the receptacle contact guide part 20 as shown in FIG. 7, for example.

Figure 19:
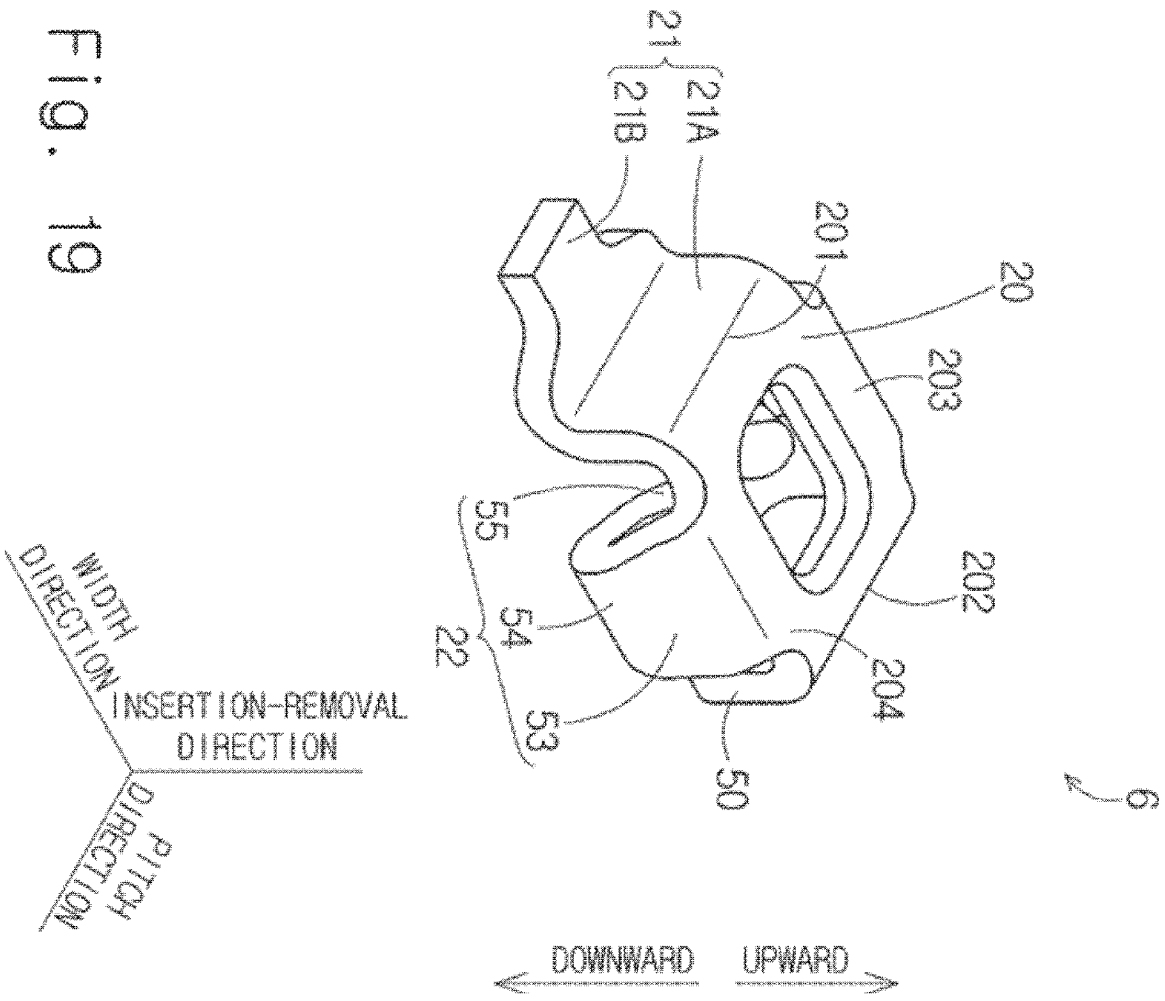
FIG. 19 is a perspective view of a receptacle contact (third embodiment)
Figure 20:
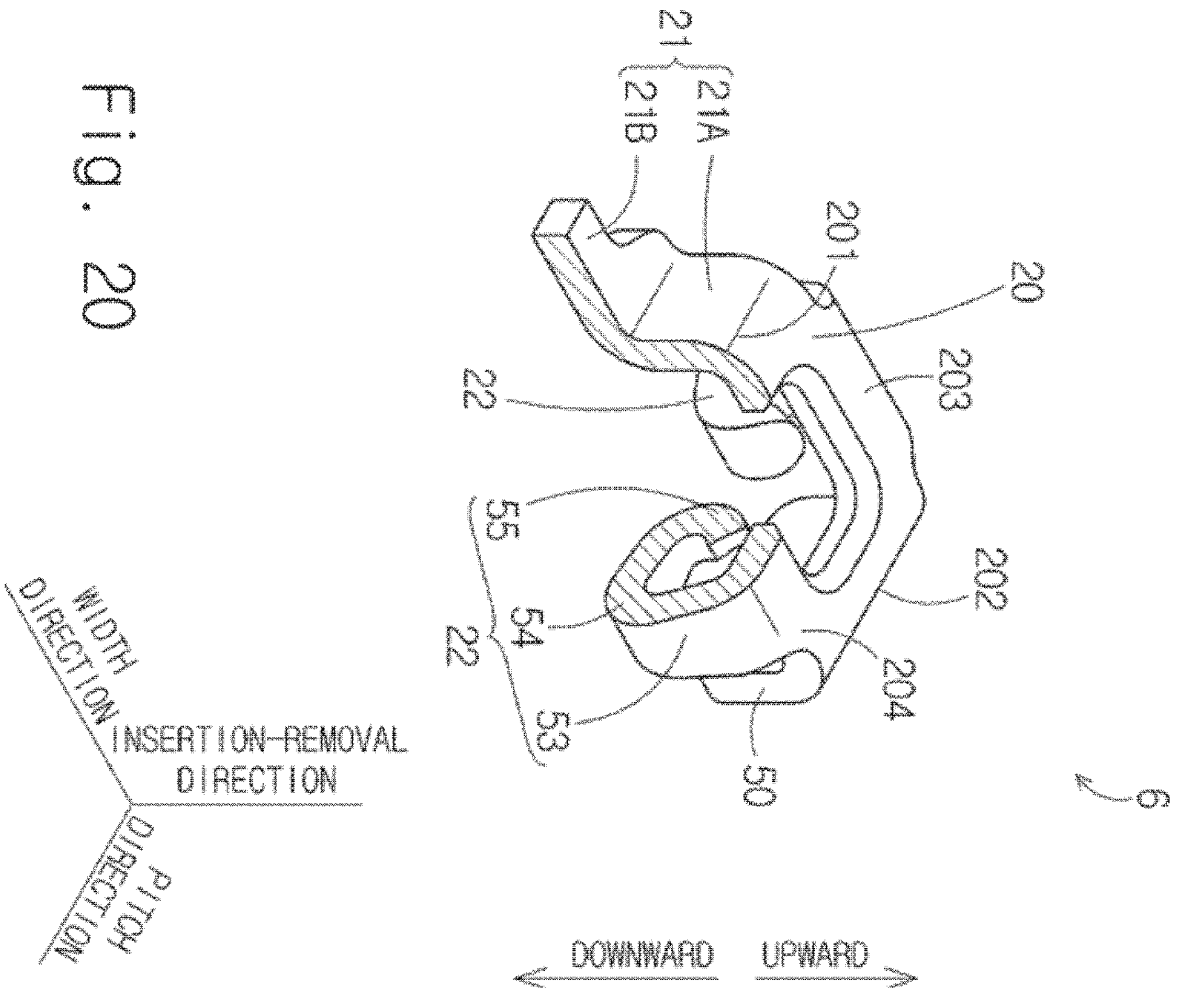
FIG. 20 is a partially cutout perspective view of the receptacle contact (third embodiment)

On the other hand, in this embodiment, the two spring pieces 22 extend like a cantilever beam respectively from the third side 203 and the fourth side 204 of the receptacle contact guide part 20 as shown in FIGS. 19 and 20.

To be specific, each spring piece 22 includes a first extension part 53 that extends from the third side 203 or the fourth side 204 of the receptacle contact guide part 20, a first curve part 54 that extends from the first extension part 53, and a second curve part 55 that extends from the first curve part 54.

The first extension part 53 of each spring piece 22 extends downward from the third side 203 or the fourth side 204 of the receptacle contact guide part 20.

The first curve part 54 of one spring piece 22 curves to be convex downward and extends toward the other spring piece 22. The same applies to the other one.

The second curve part 55 of one spring piece 22 curves to be convex toward the other spring piece 22 and extends upward. The same applies to the other one.

Further, the receptacle contact 6 according to this embodiment further includes a support leg part 50 (leg part) that extends downward from the second side 202 of the receptacle contact guide part 20.

Fourth Embodiment

A fourth embodiment is described hereinafter with reference to FIGS. 21 and 22. Hereinafter, differences of this embodiment from the first embodiment are mainly described, and redundant description is omitted.

In the above-described first embodiment, the two spring pieces 22 of the receptacle contact 6 extend from the second side 202 of the receptacle contact guide part 20 as shown in FIG. 7, for example.

Figure 22:
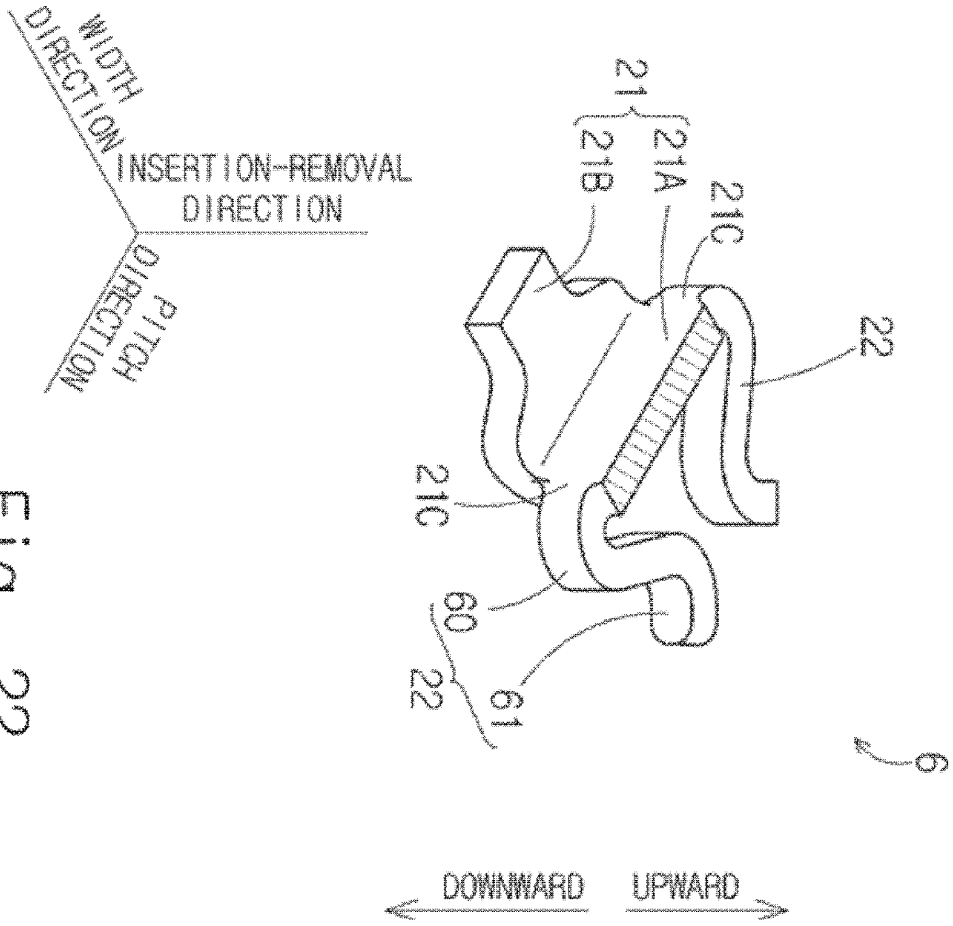
FIG. 22 is a partially cutout perspective view of the receptacle contact (fourth embodiment)
Figure 23:
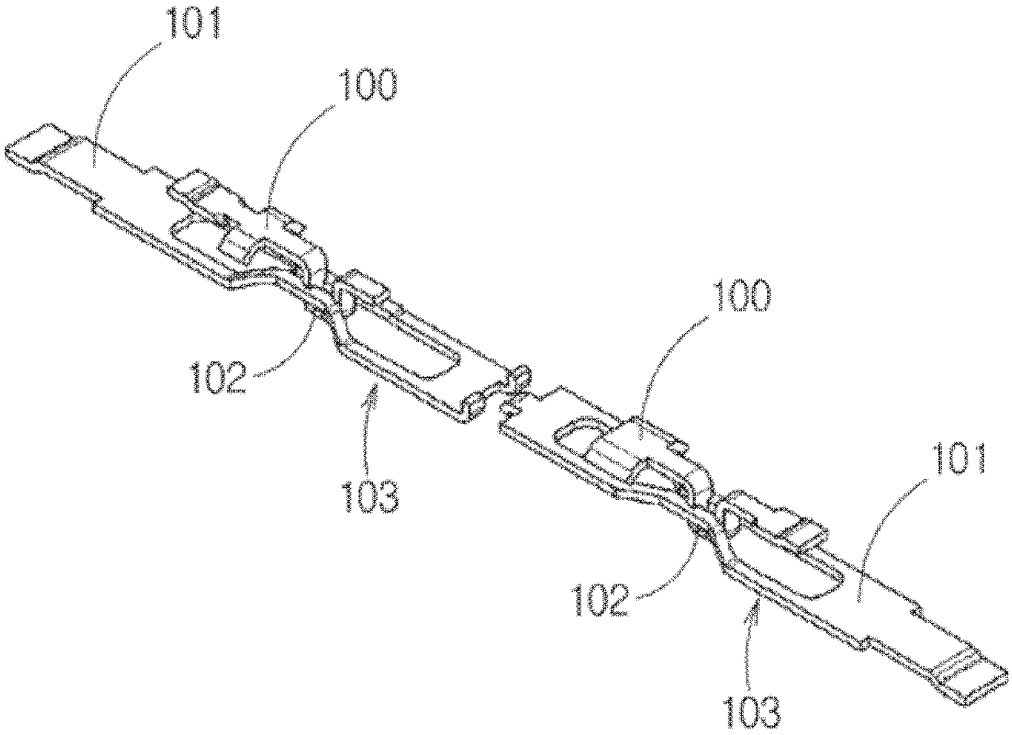
FIG. 23 is a view showing a simplified version of FIG. 24 of Japanese Unexamined Patent Application Publication No. 2019-129137.

On the other hand, in this embodiment, the two spring pieces 22 respectively extend like a cantilever beam from two side edges 21C in the pitch direction of the soldering leg main part 21A of the soldering leg part 21 as shown in FIGS. 21 and 22.

To be specific, each spring piece 22 includes a first curve part 60 that extends inward in the width direction from each side edge 21C in the pitch direction of the soldering leg main part 21A of the soldering leg part 21, and a second curve part 61 that extends inward in the width direction from the first curve part 60.

The first curve part 60 of one spring piece 22 curves to be convex in the direction of separating from the other spring piece 22 in the pitch direction. The same applies to the other one.

The second curve part 61 of one spring piece 22 curves to be convex in the direction of approaching the other spring piece 22 in the pitch direction. The same applies to the other one.

Thus, each spring piece 22 curves in an S-shape when viewed from above.

Further, as shown in FIG. 21, the receptacle contact 6 according to this embodiment further includes a support leg part 50 (leg part) that extends downward from the second side 202 of the receptacle contact guide part 20.

It should be noted that the above-described first embodiment can be modified as follows, for example. The receptacle contact 6 according to this embodiment may further include a support leg part 50 (leg part) that extends downward from the second side 202 of the receptacle contact guide part 20 as shown in FIGS. 17 and 18, for example. The two spring pieces 22 may extend like a cantilever beam from the lower end of the support leg part 50.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A connector assembly comprising:

a plug connector including a plurality of plug contacts, and a plug housing that accommodates the plurality of plug contacts, the plug connector being mountable on a plug side board; and a receptacle connector including a plurality of receptacle contacts, and a receptacle housing that accommodates the plurality of receptacle contacts, the receptacle connector being mountable on a receptacle side board, wherein each of the plug contacts and each of the receptacle contacts come into electrical contact with each other by mating the plug connector and the receptacle connector, each of the receptacle contacts includes a guide part having a guide hole into which each of the plug contacts can be inserted in a direction toward the receptacle side board, and at least one spring piece elastically deformable when each of the plug contacts is inserted into the guide hole, and the at least one spring piece comes into contact with each of the plug contacts inserted into the guide hole by a spring restoring force; wherein the at least one spring piece includes two spring pieces, each of the plug contacts inserted into the guide hole is configured to be inserted between the two spring pieces, and the two spring pieces come into contact with each of the plug contacts inserted in the guide hole by a spring restoring force, wherein the guide part is in a rectangular shape having a first side and a second side parallel to each other, where the guide hole is formed between the first side and the second side, when viewed in an insertion direction of inserting each of the plug contacts into the guide hole, each of the receptacle contacts further includes a soldering leg part extending in the insertion direction from the first side and including a soldering part solderable onto the receptacle side board, and the two spring pieces extend like a cantilever beam from the second side.

2. The connector assembly according to claim 1, wherein the guide part and the at least one spring piece are disposed in this recited order in an insertion direction of inserting each of the plug contacts into the guide hole.

3. The connector assembly according to claim 1, wherein the at least one spring piece is a cantilever beam.

4. The connector assembly according to claim 1, wherein each of the receptacle contacts includes at least one leg part projecting from the guide part in an insertion direction of inserting each of the plug contacts into the guide hole.

5. A connector assembly comprising: a plug connector including a plurality of plug contacts, and a plug housing that accommodates the plurality of plug contacts, the plug connector being mountable on a plug side board; and a receptacle connector including a plurality of receptacle contacts, and a receptacle housing that accommodates the plurality of receptacle contacts, the receptacle connector being mountable on a receptacle side board, wherein each of the plug contacts and each of the receptacle contacts come into electrical contact with each other by mating the plug connector and the receptacle connector, each of the receptacle contacts includes a guide part having a guide hole into which each of the plug contacts can be inserted in a direction toward the receptacle side board, and at least one spring piece elastically deformable when each of the plug contacts is inserted into the guide hole, and the at least one spring piece comes into contact with each of the plug contacts inserted into the guide hole by a spring restoring force; wherein the at least one spring piece includes two spring pieces, each of the plug contacts inserted into the guide hole is configured to be inserted between the two spring pieces, and two spring pieces come into contact with each of the plug contacts inserted in the guide hole by a spring restoring force, wherein the guide part is in a rectangular shape having a first side and a second side parallel to each other, where the guide hole is formed between the first side and the second side, when viewed in an insertion direction of inserting each of the plug contacts into the guide hole, each of the receptacle contacts further includes a soldering leg part extending in the insertion direction from the first side and including a soldering part solderable onto the receptacle side board, and a support leg part extending in the insertion direction from the second side, and the two spring pieces extend like a cantilever mean from the support leg part.

6. A connector assembly comprising: a plug connector including a plurality of plug contacts, and a plug housing that accommodates the plurality of plug contacts, the plug connector being mountable on a plug side board; and a receptacle connector including a plurality of receptacle contacts, and a receptacle housing that accommodates the plurality of receptacle contacts, the receptacle connector being mountable on a receptacle side board, wherein each of the plug contacts and each of the receptacle contacts come into electrical contact with each other by mating the plug connector and the receptacle connector, each of the receptacle contacts includes a guide part having a guide hole into which each of the plug contacts can be inserted in a direction toward the receptacle side board, and at least one spring pieces elastically deformable when each of the plug contacts is inserted into the guide hole, and the at least one spring piece comes into contact with each of the plug contacts inserted into the guide hole by a spring restoring force; wherein the at least one spring piece includes two spring pieces, each of the plug contacts inserted into the guide hole is configured to be inserted between the two spring pieces, and the two spring pieces come into contact with each of the plug contacts inserted into the guide hole by a spring restoring force, wherein the guide part is in a rectangular shape having a first side and a second side parallel to each other and a third side and a fourth side parallel to each other, where the guide hole is formed between the first side and the second side, when viewed in an insertion direction of inserting each of the plug contacts into the guide hole, each of the receptacle contacts further includes a soldering leg part extending in the insertion direction from the first side and including a soldering part solderable onto the receptacle side board, and the two spring pieces extend like a cantilever beam from the third side and the fourth side, respectively.

7. The connector assembly according to claim 1, wherein the guide part is in a rectangular shape having a first side and a second side parallel to each other, where the guide hole is formed between the first side and the second side, when viewed in an insertion direction of inserting each of the plug contacts into the guide hole, each of the receptacle contacts further includes a soldering leg part extending in the insertion direction from the first side and including a soldering part solderable onto the receptacle side board, and the two spring pieces extend like a cantilever beam from the soldering leg part.

* * * * *